US011804094B2

(12) United States Patent
Nakaoka et al.

(10) Patent No.: US 11,804,094 B2
(45) Date of Patent: Oct. 31, 2023

(54) MEDIUM PROCESSING DEVICE AND AUTOMATED TELLER MACHINE

(71) Applicant: Oki Electric Industry Co., Ltd., Tokyo (JP)

(72) Inventors: Yoichi Nakaoka, Tokyo (JP); Toru Nagaoka, Tokyo (JP); Madoka Wakabayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/776,819

(22) PCT Filed: Oct. 2, 2020

(86) PCT No.: PCT/JP2020/037534
§ 371 (c)(1),
(2) Date: May 13, 2022

(87) PCT Pub. No.: WO2021/106371
PCT Pub. Date: Jun. 3, 2021

(65) Prior Publication Data

US 2022/0383686 A1 Dec. 1, 2022

(30) Foreign Application Priority Data

Nov. 26, 2019 (JP) ..... 2019-213499

(51) Int. Cl.

| | |
|---|---|
| ***G07D 11/14*** | (2019.01) |
| ***G07D 11/00*** | (2019.01) |
| ***G07D 11/10*** | (2019.01) |
| ***B65H 31/26*** | (2006.01) |

(52) U.S. Cl.
CPC ..... *G07D 11/14* (2019.01); *B65H 31/26* (2013.01); *B65H 2701/1912* (2013.01); *G07D 2211/00* (2013.01)

(58) Field of Classification Search
CPC .... G07D 11/14; G07D 2211/00; B65H 31/26; B65H 2701/1912; B65H 31/00
See application file for complete search history.

(56) References Cited

U.S. PATENT DOCUMENTS 6,338,048 B1 * 1/2002 Mori ..... G06Q 20/105 705/41
6,536,662 B1 * 3/2003 Ohno ..... G07F 19/20 235/382

(Continued)

FOREIGN PATENT DOCUMENTS

JP 2010157150 A * 7/2010
JP 2014157387 A 8/2014

(Continued)

OTHER PUBLICATIONS

Office Action dated Jan. 31, 2023, in the counterpart of Japanese Patent application. No. 2019-213499.

*Primary Examiner* — Tuyen K Vo
(74) *Attorney, Agent, or Firm* — Rabin & Berdo, P.C.

(57) ABSTRACT

While a bill controller is moving a bill press and a pool guide from accumulation positions to delivery positions, a time period from a time point to a time point for moving both the bill press and the pool guide and a time period from the time point to a time point for moving only the pool guide are given.

9 Claims, 16 Drawing Sheets

(56) References Cited

U.S. PATENT DOCUMENTS

| | | | | |
|---|---|---|---|---|
| 2011/0052363 | A1* | 3/2011 | Brexel | G07D 11/13 414/798.2 |
| 2011/0155540 | A1* | 6/2011 | Ugajin | G07D 11/50 198/780 |
| 2012/0313493 | A1* | 12/2012 | Yokote | B65H 29/006 271/10.09 |
| 2014/0070478 | A1* | 3/2014 | Huang | B65H 1/14 271/3.22 |
| 2014/0116840 | A1* | 5/2014 | Maekawa | G07D 7/04 194/320 |
| 2015/0356807 | A1* | 12/2015 | Wakabayashi | G07D 11/13 194/350 |

FOREIGN PATENT DOCUMENTS

| | | | |
|---|---|---|---|
| JP | 2014164399 | A | 9/2014 |
| JP | 2014229185 | A | 12/2014 |
| JP | 2016081342 | A | 5/2016 |
| JP | 2018005351 | A | 1/2018 |
| WO | 2016059839 | A1 | 4/2016 |

* cited by examiner

21

MEDIUM PROCESSING DEVICE AND AUTOMATED TELLER MACHINE

TECHNICAL FIELD

The present invention relates to a medium processing device and an automated teller machine and is suitable for application to, for example, an automatic teller machine (ATM) that receives a paper sheet shaped medium such as bills and performs desired transactions.

BACKGROUND ART

Generally, automatic teller machines employed in financial institutions and the like are configured to perform various kinds of transactions according to the contents of a transaction with a user (for example, customer of the financial institutions), for example deposit transactions in which the user deposits cash such as bills or coins, or withdrawal transactions in which cash is withdrawn to the user.

For example, the automatic teller machine includes a bill deposit/withdrawal device that performs processes relating to bill deposit and withdrawal. In addition, the bill deposit/withdrawal device also includes a customer interface section that exchanges bills with the user.

For example, the customer interface section of the bill deposit/withdrawal device includes a bill press and a pool guide (for example, see Patent Literature 1. FIG. 14 illustrates a configuration of the bill deposit/withdrawal device. As illustrated in FIG. 14, the bill deposit/withdrawal device includes a container 200, a bill press 201, and a pool guide 202, for example. The bill press 201 and the pool guide 202 are disposed in the container 200.

The container 200 is provided with an intake port 200*a* and a discharge port 200*b*. The intake port 200*a* for taking in bills input into the container 200 is provided on a front end side of a bottom surface of the container 200. The discharge port 200*b* for discharging bills into the container 200 is provided on a rear end side of the bottom surface of the container 200. The bill press 201 and the pool guide 202 are opposed to each other and have a positional relation in such a manner that the bill press 201 is provided on a rear side and the pool guide 202 is provided on a front side. The bill press 201 and the pool guide 202 are movable along the bottom surface of the container 200 in a front-rear direction.

At time of the withdrawal transaction, the customer interface section moves the bill press 201 and the pool guide 202 to accumulation positions near the discharge port 200*b*, discharges bills from the discharge port 200*b* into an accumulation space, and accumulates the bills in the accumulation space. The accumulation space is made between the bill press 201 and the pool guide 202. In addition, the customer interface section moves the bill press 201 and the pool guide 202 to delivery positions (positions for delivering the bills to the user) in a state where the bills are accumulated between the bill press 201 and the pool guide 202. The delivery positions are anterior to the accumulation positions. At this time, the customer interface section moves the bill press 201 and the pool guide 202 to the delivery positions while widening the gap between the bill press 201 and the pool guide 202 in such a manner that the gap becomes equal to or greater than the thickness of a set of accumulated bills BL. Subsequently, the customer interface section allows the user to take out the bills accumulated between the bill press 201 and the pool guide 202.

CITATION LIST

Patent Literature

Patent Literature 1: JP 2018-5351A

DISCLOSURE OF INVENTION

Technical Problem

However, the conventional customer interface section widens the gap between the bill press 201 and the pool guide 202 while moving the bill press 201 and the pool guide 202 from the accumulation positions to the delivery positions. Therefore, the conventional customer interface section has a problem that the bills accumulated between the bill press 201 and the pool guide 202 are not stable and sometimes becomes disarrayed, and it may become difficult to take out the bills.

The present invention was conceived in view of the above-described points, and the present invention proposes a medium processing device and an automated teller machine that make it easier to take out media than conventional technologies.

Solution to Problem

To solve the above-described problems, according to the present invention, there is provided a medium processing device including: a container configured to contain a medium to be delivered to a user; a bill press and a pool guide configured to be opposed in the container and movable along a bottom surface of the container; and a control section configured to control movements of the bill press and the pool guide. A first time period and a second time period subsequent to the first time period are provided while the control section causes each of the bill press and the pool guide to move from an accumulation position to a delivery position, the first time period being a time period where both the bill press and the pool guide move, the second time period being a time period where one of the bill press and the pool guide moves, the accumulation position being a position for accumulating the medium conveyed to the container, the delivery position being a position for delivering the medium accumulated between the bill press and the pool guide to the user.

Therefore, it is possible to move the bill press and the pool guide in a direction from the accumulation positions toward the delivery positions in the first time period while maintaining a gap between the bill press and the pool guide. This makes it possible to prevent media accumulated between the bill press and the pool guide from becoming disarrayed while moving. In addition, in the second time period, the gap between the bill press and the pool guide are widened. This makes it easier to take out the media.

Advantageous Effects of Invention

According to the present invention, it is possible to achieve the medium processing device and the automated teller machine that make it easier to take out media than conventional technologies.

MODE(S) FOR CARRYING OUT THE INVENTION

Next, modes (hereinafter, referred to as embodiments) for carrying out the present invention will be described with reference to drawings.

1. Overall Configuration of Automatic Teller Machine

Figure 1:
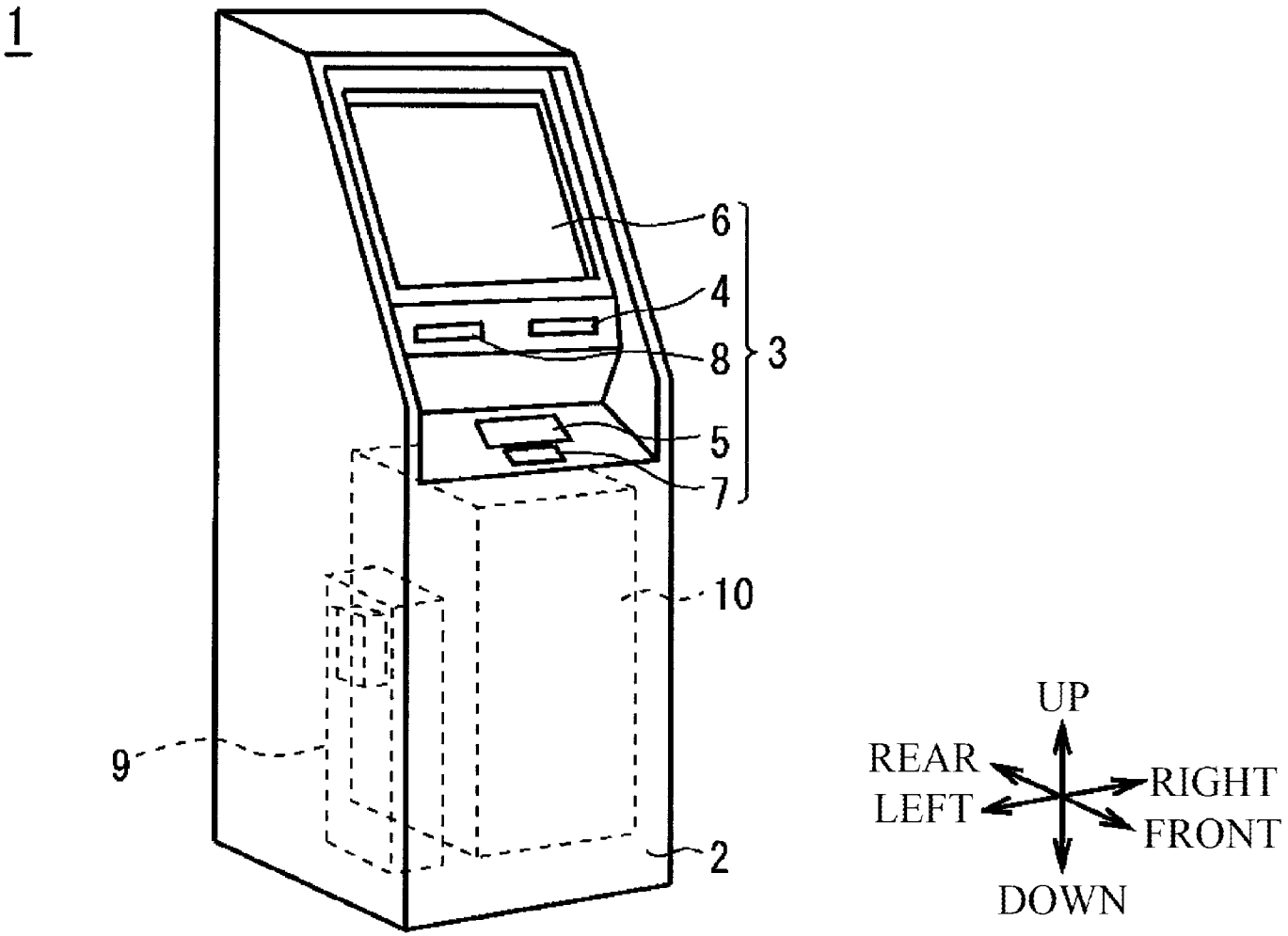
FIG. 1 is a perspective view illustrating an external configuration of an automatic teller machine.

FIG. 1 illustrates an external appearance of an automatic teller machine 1 serving as an automated teller machine. For example, the automatic teller machine 1 is installed in financial institutions, various kinds of shopping malls, and the like, and conducts transactions relating to cash, such as a deposit process, a withdrawal process and the like with users (for example, customers of the financial institutions or shopping malls). Note that, in this specification, a front side facing the user is defined as a front side of the automatic teller machine 1, a side opposite to the front side is defined as a rear side of the automatic teller machine 1, and an upper side, a lower side, a left side, and a right side viewed from the user who faces the front side of the automatic teller machine 1 are respectively defined as an upper side, a lower side, a left side, and a right side of the automatic teller machine 1.

The external appearance of the automatic teller machine 1 is made of a substantially box-shaped casing 2. The casing 2 includes an interface section 3 at a position where a user facing a front side of the casing 2 easily inserts bills, easily operates a touchscreen, and easily conducts other operations.

The interface section 3 is provided with a card insertion/removal port 4, a deposit/withdrawal port 5, an operation/display section 6, a numeric keypad 7, a receipt issue port 8, and the like. The interface section 3 directly exchanges cash, a passbook, and the like with a customer, and notifies of transaction-related information and receives operation instructions. The card insertion/removal port 4 is a section where various kinds of cards, such as a cash card, are inserted and returned. A card processor (not illustrated) that reads account numbers and the like magnetically recorded on the various kinds of cards is provided deep inside the card insertion/removal port 4. The deposit/withdrawal port 5 is a section where bills deposited by a customer are inserted, and where bills to be delivered to the customer are dispensed. A shutter is driven to open and close the deposit/withdrawal port 5.

The operation/display section 6 is a touchscreen integrated with a liquid crystal display and a touch sensor. The liquid crystal display displays operation screens, transaction details, and the like with regard to transactions. The touch sensor detects input operations conducted by the user. The numeric keypad 7 is a physical keypad that receives input of numbers and the like such as 0 to 9. The numeric keypad 7 is used for performing operation of inputting a personal identification number, a transaction amount, and the like. The receipt issue port 8 is a section that issues a receipt printed with transaction details and the like at the end of transaction processing. A receipt processor (not illustrated) that prints the transaction details and the like on the receipt is provided deep inside the receipt issue port 8.

In the casing 2, there are provided a main controller 9, a bill deposit/withdrawal device 10, and the like. The main controller 9 integrally controls the whole automatic teller machine 1. The bill deposit/withdrawal device 10 performs various kinds of processes relating to bills. The main controller 9 mainly includes a central processing unit (CPU) (not illustrated). The main controller 9 reads predetermined programs from read-only memory (ROM), flash memory, or the like (not illustrated) and executes the predetermined programs to perform various kinds of processes such as a deposit process and a withdrawal process. In addition, the main controller 9 includes a storage section including random-access memory (RAM), a hard disk drive, flash memory, or the like. The storage section stores various kinds of information.

2. Configuration of Bill Deposit/Withdrawal Device

Figure 2:
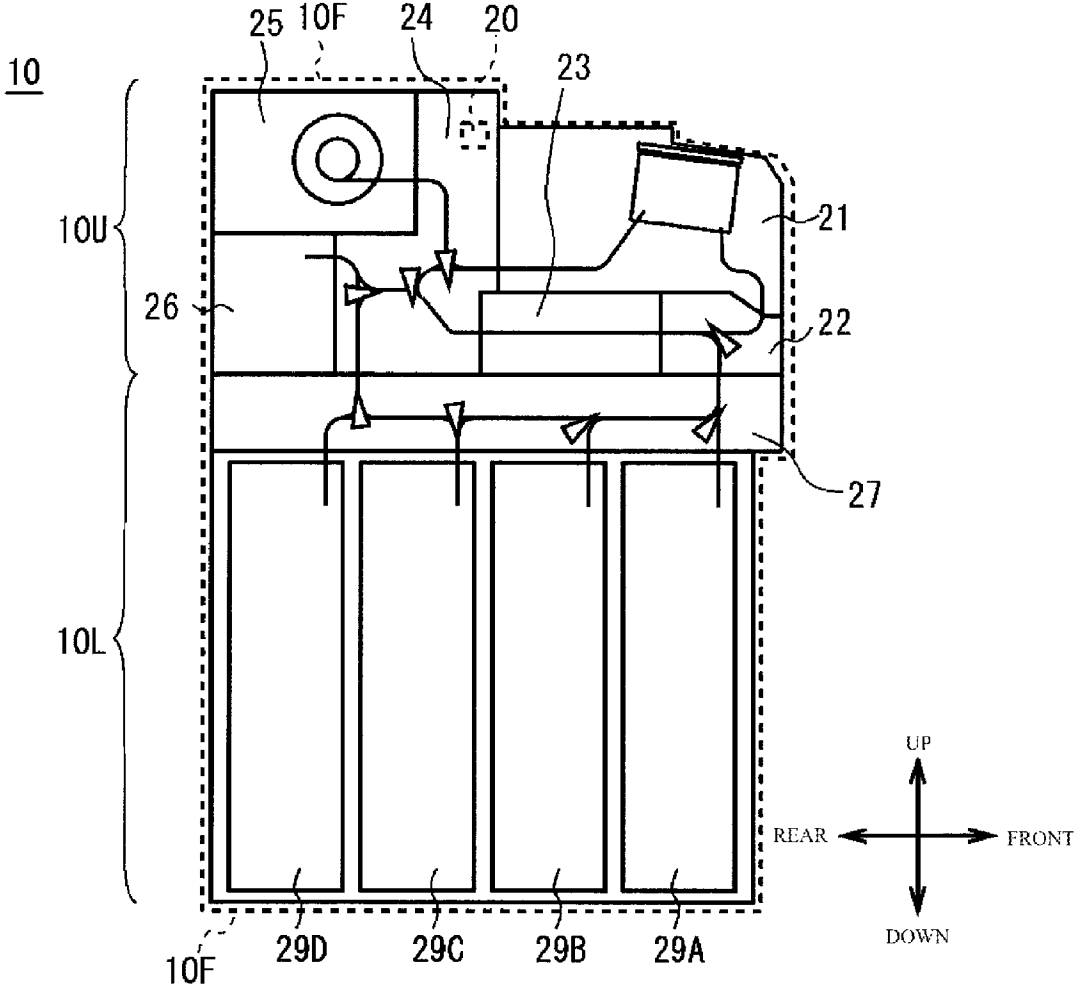
FIG. 2 is a side sectional view illustrating a configuration of a bill deposit/withdrawal device.

Next, an internal configuration of the bill deposit/withdrawal device 10 will be described with reference to FIG. 2. Note that, FIG. 2 is a side sectional view of the bill deposit/withdrawal device 10. The bill deposit/withdrawal device 10 is roughly divided into an upper unit 10U, a lower unit 10L, and a frame 10F. The upper unit 10U occupies an upper portions of the whole bill deposit/withdrawal device 10. The lower unit 10L occupies a lower portions of the whole bill deposit/withdrawal device 10. The frame 10F supports the upper unit 10U and the lower unit 10L.

The frame 10F is attached to an inside of the casing 2 (FIG. 1). The frame 10F supports the upper unit 10U and the lower unit 10L through respective slide rails that extend in a front-rear direction. This makes it possible to pull out the upper unit 10U and the lower unit 10L of the bill deposit/withdrawal device 10 from the frame 10F in a front direction (or a rear direction) in a state where a front door (or rear door) of the casing 2 is open. In addition, it is possible to house the upper unit 10U and the lower unit 10L in the frame 10F by pushing the pulled-out upper unit 10U and lower unit 10L into the frame 10F.

2-1. Configuration of Upper Unit

Figure 3A:
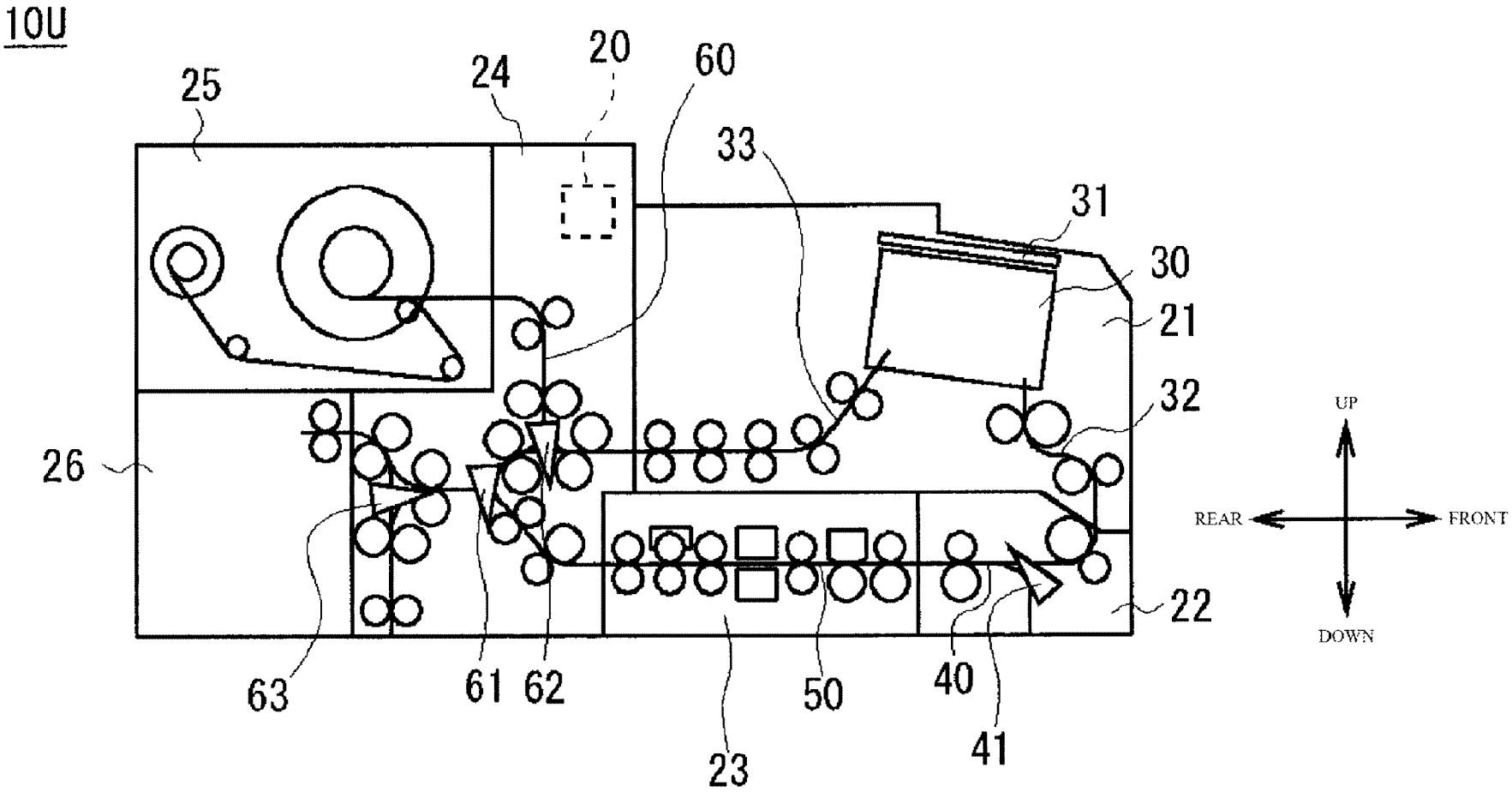
FIG. 3A is a side sectional view illustrating a configuration of an upper unit.

As illustrated in FIG. 3A, which is an enlarged view of the upper section illustrated in FIG. 2, the upper unit 10U includes a bill controller 20, a customer interface section 21, an upper front conveyance section 22, a classification section 23, an upper rear conveyance section 24, a temporary holding section 25, and a reject box 26. The bill controller 20 integrally controls the whole upper unit 10U.

The bill controller 20 mainly includes a CPU (not illustrated). The bill controller 20 reads predetermined programs from ROM, flash memory, or the like (not illustrated) and executes the predetermined programs to perform various kinds of processes such as a process of deciding conveyance destinations of bills and a process of controlling operation of various sections. In addition, the bill controller 20 includes a storage section including RAM, flash memory, or the like. The storage section stores various kinds of information. Note that, the position of the bill controller 20 illustrated in FIG. 3 is a mere example. The bill controller 20 may be installed at a different position.

The customer interface section 21 is a section that allows a user to deposit or withdraw bills by exchanging the bills with the user. The customer interface section 21 includes a container 30 that contains bills. An upper end of the container 30 serves as an opening linked to the deposit/withdrawal port 5 (FIG. 1). The opening of the container 30 of the customer interface section 21 is configured to be opened or closed by a shutter 31. In addition, the customer interface section 21 includes a conveyance path 32 and a conveyance path 33. The conveyance path 32 links a front end section of the container 30 to the upper front conveyance section 22 positioned below a front side of the customer interface section 21. The conveyance path 33 links a rear end section of the container 30 to the upper rear conveyance section 24 positioned behind the customer interface section 21.

The customer interface section 21 conveys bills contained in the container 30 to the upper front conveyance section 22 along the conveyance path 32 by using conveyance rollers while separating the bills one by one. The conveyance rollers are indicated by circles in FIG. 3A. In addition, the customer interface section 21 conveys bills from the upper rear conveyance section 24 to the container 30 along the conveyance path 33 by using the conveyance rollers, and discharges the bills into the container 30.

The upper front conveyance section 22 is positioned on a lower front side within the upper unit 10U. The upper front conveyance section 22 includes a conveyance path 40 and a switch 41. The conveyance path 40 is provided with a single branch point. The switch 41 is provided at the branch point of the conveyance path 40 and switches a bill conveyance route. The conveyance path 40 is connected to the conveyance path 32 of the customer interface section 21, the classification section 23, and a front section of the lower unit 10L.

By operating the switch 41 under the control of the bill controller 20, the upper front conveyance section 22 switches the bill conveyance route based on the conveyance path 40 to a conveyance route that links the conveyance path 32 of the customer interface section 21 to the classification section 23, or a conveyance route that links the classification section 23 to the front section of the lower unit 10L. Next, the upper front conveyance section 22 conveys the bills by using the conveyance rollers along the switched conveyance route.

The classification section 23 is positioned below the customer interface section 21 and behind the upper front conveyance section 22. The classification section 23 includes a straight conveyance path 50 that connects the upper front conveyance section 22 positioned in front of the classification section 23 to the upper rear conveyance section 24 positioned behind the classification section 23. A plurality of sensors is disposed along the conveyance path 50. The classification section 23 determines denomination, authenticity, deformation (whether bills are damaged), and the like of bills and recognizes a conveyance state on the basis of detection results obtained from the plurality of sensors while conveying the bills by using the conveyance rollers along the conveyance path 50. In addition, the classification section 23 transmits these classification results to the bill controller 20.

The upper rear conveyance section 24 is positioned behind the customer interface section 21 and the classification section 23. The upper rear conveyance section 24 includes a conveyance path 60 and switches 61, 62, and 63. The conveyance path 60 is provided with three branch points. The switches 61, 62, and 63 are provided at the respective branch points.

The conveyance path 60 is connected to the conveyance path 33 of the customer interface section 21, the classification section 23, the temporary holding section 25, the reject box 26, and a rear section of the lower unit 10L. By operating the three switches 61, 62, and 63 under the control of the bill controller 20, the upper rear conveyance section 24 switches a bill conveyance route based on the conveyance path 60 to a conveyance route that links the classification section 23 to the temporary holding section 25, a conveyance route that links the classification section 23 to the conveyance path 33 of the customer interface section 21, a conveyance route that links the classification section 23 to the reject box 26, or a conveyance route that links the rear section of the lower unit 10L to the reject box 26. Next, the upper rear conveyance section 24 conveys the bills by using the conveyance rollers along the switched conveyance route.

For example, the temporary holding section 25 may employ tape. In this case, the temporary holding section 25 stores bills conveyed from the upper rear conveyance section 24 by winding the bills and the tape around a peripheral surface of a drum. In addition, in the case of ejecting the bills, the temporary holding section 25 peels the bills and the tape from the peripheral surface of the drum and delivers the bills to the upper rear conveyance section 24.

The reject box 26 is a portion that stores rejected bills that are determined to be heavily damaged and unsuitable for withdrawal, for example. When the rejected bills are conveyed from the upper rear conveyance section 24, the rejected bills are discharged and stored in a storage space in the reject box 26.

2-2. Configuration of Lower Unit

Figure 3B:
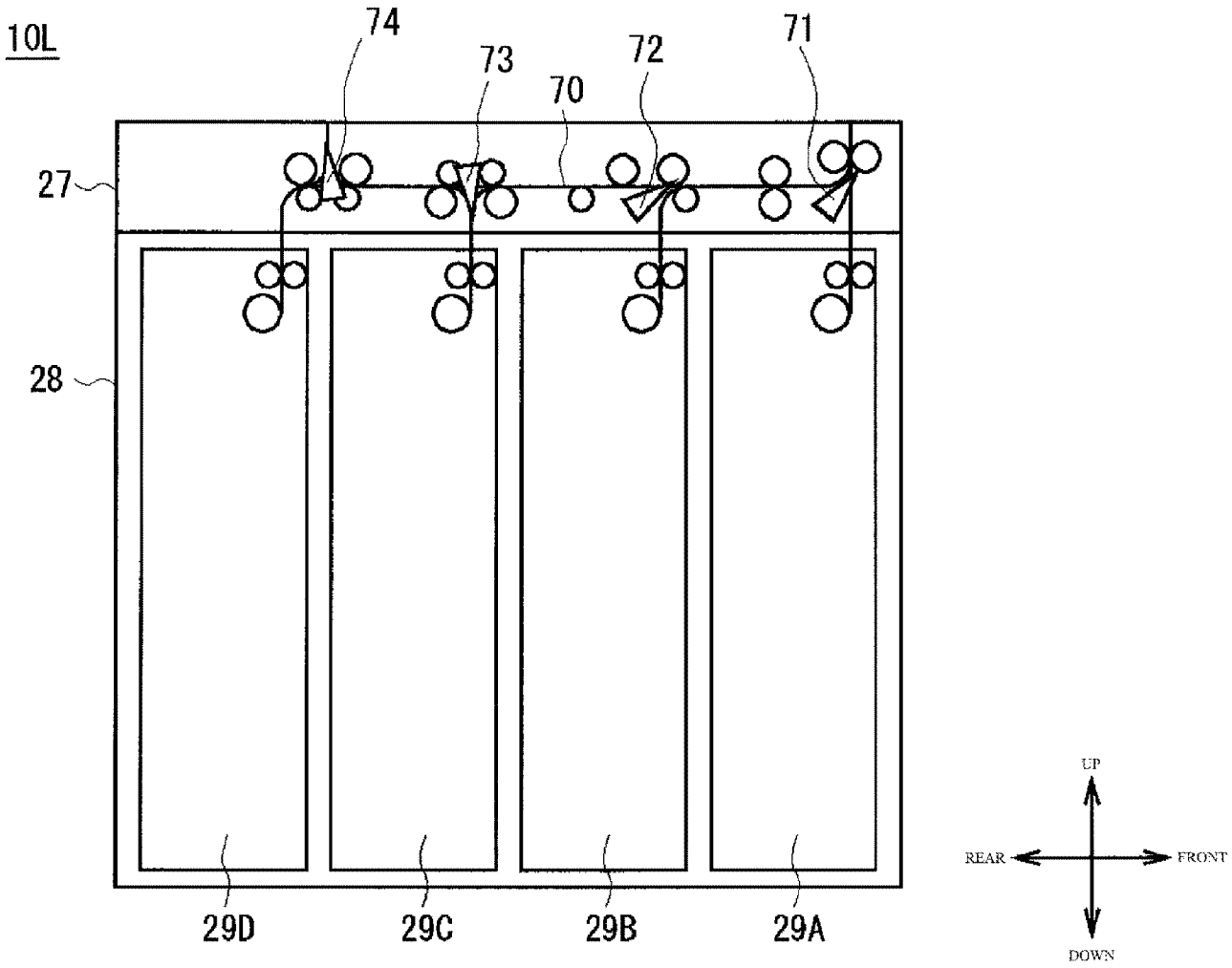
FIG. 3B is a side sectional view illustrating a configuration of a lower unit.

As illustrated in FIG. 3B, which is an enlarged view of the lower section illustrated in FIG. 2, an upper end portion of the lower unit 10L includes a lower conveyance section 27, and a lower frame 28 is provided below the lower conveyance section 27. The lower frame 28 has a hollow rectangular shape with an open upper end. In the lower frame 28, there are four bill storage boxes 29 (29A, 29B, 29C, and 29D) aligned in the front-rear direction. Each of the bill storage boxes 29 stores reusable (recyclable) bills therein.

The bill storage boxes 29 (29A to 29D) have similar configurations to each other. Each of the bill storage boxes 29 has a rectangular shape that extends in an up-down direction. Each of the bill storage boxes 29 is capable of storing and ejecting bills. When storing bills, bills conveyed from the lower conveyance section 27 are discharged and accumulated in a storage space in each of the bill storage boxes 29. Alternatively, when ejecting bills, each of the bill storage boxes 29 separates the bills accumulated in each storage space one by one from the top, conveys the separated bill upward, and delivers the conveyed bill to the lower conveyance section 27. Each of the bill storage boxes 29 is preset with a bill denomination to be stored therein.

The lower conveyance section 27 includes a conveyance path 70 and switches 71, 72, 73 and 74. The conveyance path 70 is provided with four branch points. The switches 71, 72, 73 and 74 are provided at the respective branch points. The conveyance path 70 is connected to the upper front conveyance section 22, the upper rear conveyance section 24, and the bill storage boxes 29A, 29B, 29C, and 29D. By operating the four switches 71, 72, 73, and 74 under the control of the bill controller 20, the lower conveyance section 27 switches a bill conveyance route based on the conveyance path 70 to a conveyance route that links the upper front conveyance section 22 to any of the bill storage boxes 29A to 29D, or a conveyance route that links the upper front conveyance section 22 to the upper rear conveyance section 24. Next, the lower conveyance section 27 conveys the bills by using conveyance rollers along the switched conveyance route.

Note that, the example in which the lower frame 28 is provided with the plurality of bill storage boxes 29 has been described above. However, the present invention is not limited thereto. For example, the lower frame 28 may be provided with the plurality of bill storage boxes 29 and a forgotten bill storage box that stores bills that the user has forgotten to take out.

3. Deposit Transaction Operation and Withdrawal Transaction Operation

Next, operation performed by the bill deposit/withdrawal device 10 at the time of deposit transaction and operation performed by the bill deposit/withdrawal device 10 at the time of withdrawal transaction will be briefly described. First, the deposit transaction operation will be described. At the time of deposit transaction, the bill deposit/withdrawal device 10 first performs a deposit counting process to count the number of bills deposited by the user while classifying denominations and the like of the bills, before performing a deposit storage process to convey the bills to an appropriate storage location to be stored. Note that, the deposit counting process and the deposit storage process are performed while the bill controller 20 controls respective sections.

Specifically, the bill deposit/withdrawal device 10 starts the deposit counting process when receiving an operation instruction to start a deposit transaction, from the user via the operation/display section 6 (FIG. 1). When the deposit counting process starts, the bill deposit/withdrawal device 10 opens the shutter 31 of the customer interface section 21 (FIG. 3A). Subsequently, when the user inserts bills into the container 30, the bill deposit/withdrawal device 10 closes the shutter 31 of the customer interface section 21, separates the bills in the container 30 one by one, and conveys the separated bills to the classification section 23 via the upper front conveyance section 22. Here, with regard to bills determined as normal bills on the basis of a classification result obtained from the classification section 23, the bill deposit/withdrawal device 10 conveys the bills from the classification section 23 to the temporary holding section 25 via the upper rear conveyance section 24 and stores the bills in the temporary holding section 25. Alternatively, with regard to bills determined as deposit rejected bills on the basis of a classification result obtained from the classification section 23, the bill deposit/withdrawal device 10 conveys the bills from the classification section 23 to the conveyance path 33 of the customer interface section 21 via the upper rear conveyance section 24 and retracts the bills onto the conveyance path 33. The deposit rejected bills are bills that are not appropriate for deposit.

Next, when all the bills inserted in the container 30 is ejected, the bill deposit/withdrawal device 10 returns the bills retracted onto the conveyance path 33 (that is, deposit rejected bills) to the container 30, opens the shutter 31, and returns the bills to the user. On the other hand, the bill deposit/withdrawal device 10 finishes the deposit counting process in the case where there is no bill retracted onto the conveyance path 33. Subsequently, the bill deposit/withdrawal device 10 calculates a deposit amount on the basis of results of tallying the denominations and the number of bills taken in from the customer interface section 12, displays a predetermined operation instruction screen on the operation/display section 6 (FIG. 1), presents the deposit amount to the user, and allows the user to select whether or not to continue with the deposit transaction.

Here, in the case where the user has instructed to stop the deposit transaction, the bill deposit/withdrawal device 10 returns all the bills stored in the temporary holding section 25 to the container 30 of the customer interface section 21, opens the shutter 31 (FIG. 3A), and returns all the bills to the user. Alternatively, the bill deposit/withdrawal device 10 starts the deposit storage process in the case where the user has instructed to continue with the deposit transaction. When the deposit storage process starts, the bill deposit/withdrawal device 10 sequentially ejects the bills stored in the temporary holding section 25 (that is, normal bills), conveys the bills to the classification section 23 via the upper rear conveyance section 24, and determines the denominations. Next, the bill deposit/withdrawal device 10 causes the bills whose denomination is determined to go from the classification section 23 to the upper front conveyance section 22 and the lower conveyance section 27 in this order, and conveys to and stores in the respective bill storage boxes 29 corresponding to appropriate denominations. The bill deposit/withdrawal device 10 finishes the deposit storage process when all the bills stored in the temporary holding section 25 is conveyed to the appropriate bill storage boxes 29. The operation performed by the bill deposit/withdrawal device 10 at the time of deposit transaction has been described above.

Next, operation performed by the bill deposit/withdrawal device 10 at the time of a withdrawal transaction will be described. At the time of the withdrawal transaction, the bill deposit/withdrawal device 10 performs a withdrawal process to withdraw bills in numbers and denominations that make up an amount of money designated by the user. Note that, the withdrawal process is performed while the bill controller 20 controls the respective sections.

Specifically, the bill deposit/withdrawal device 10 starts the withdrawal process when receiving an operation instruction to start a withdrawal transaction and designate a withdrawal amount, from the user via the operation/display section 6 (FIG. 1). When the withdrawal process starts, the bill deposit/withdrawal device 10 decides the denominations and the number of bills that make up the withdrawal amount. Next, on the basis of the decided denominations and number of bills, the bill deposit/withdrawal device 10 ejects bills one by one from the respective bill storage boxes 29, and causes the bills to go to the lower conveyance section 27 and the upper front conveyance section 22 in this order, and conveys the bills to the classification section 23.

Here, with regard to bills determined as normal bills on the basis of a classification result obtained from the classification section 23, the bill deposit/withdrawal device 10 conveys the bills from the classification section 23 to the customer interface section 21 via the upper rear conveyance section 24 and accumulates the bills in the container 30. Alternatively, with regard to bills determined as withdrawal rejected bills on the basis of a classification result obtained from the classification section 23, the bill deposit/withdrawal device 10 conveys the bills from the classification section 23 to the reject box 26 via the upper rear conveyance section 24 and stores the bills in the reject box 26. The withdrawal rejected bills are bills that are not appropriate for withdrawal. Next, when the bills that make up the withdrawal amount are accumulated in the container 30, the bill deposit/withdrawal device 10 opens the shutter 31 of the customer interface section 21 and allows the user to take out the bills accumulated in the container 30. The operation performed by the bill deposit/withdrawal device 10 at the time of withdrawal transaction has been described above.

4. Configuration of Customer Interface Section

Figure 4:
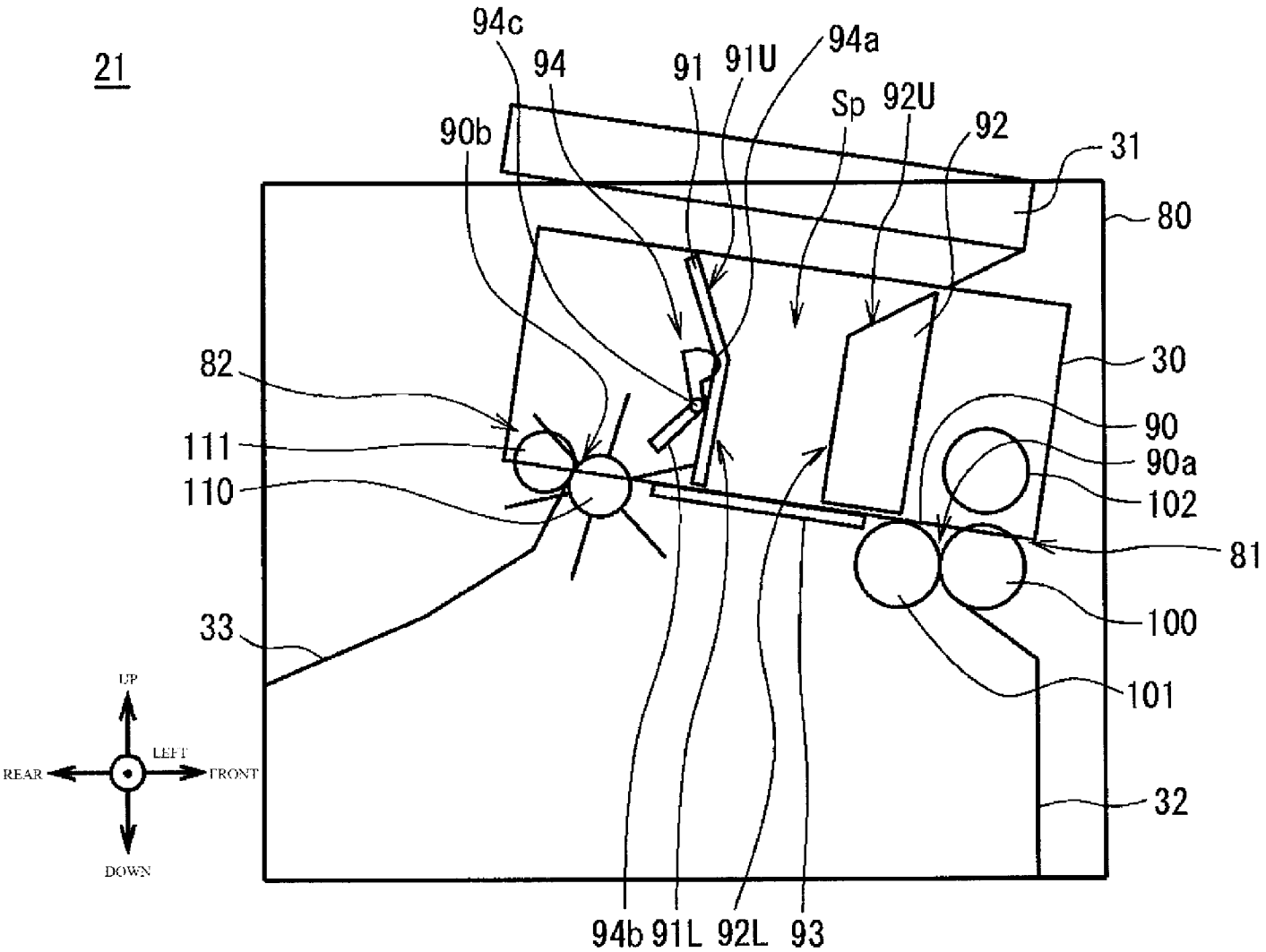
FIG. 4 is a side sectional view illustrating a configuration of a customer interface section.

Next, an internal configuration of the customer interface section 21 will be described with reference to FIG. 4. Note that, FIG. 4 is a side sectional view of the customer interface section 21. In FIG. 4, some of the conveyance rollers and the like are omitted. In the customer interface section 21, a casing 80 includes the container 30, a separation/ejection mechanism 81, an accumulation mechanism 82, the conveyance path 32, and the conveyance path 33 therein.

The container 30 has a box shape. An upper end of the container 30 serves as an opening linked to the deposit/withdrawal port 5 (FIG. 1). The opening is configured to be opened or closed by the shutter 31. In addition, the container 30 is provided in the casing 80 in such a manner that the container 30 is tilted forward and a front end side of the container 30 is positioned lower than a rear end side of the container 30. The container 30 is provided with a lower frame 90, side guides (not illustrated), a bill press 91, and a pool guide 92.

The lower frame 90 is a frame that forms a bottom surface of the container 30, and is tilted forward in such a manner that a front end side of the lower frame 90 is positioned lower than a rear end side of the lower frame 90. In other words, the bottom surface of the container 30 is tilted forward in such a manner that the front end side is positioned lower than the rear end side. The lower frame 90 is provided with an intake port 90*a* and a discharge port 90*b*. The intake port 90*a* for taking in bills contained in the container 30 from the container 30 is provided on the front end side of the lower frame 90. The discharge port 90*b* for discharging bills into the container 30 is provided on the rear end side of the lower frame 90. Note that, the container 30 contains rectangular bills in such a manner that a long-side direction of the bills corresponds to a left-right direction, a short-side direction of the bill corresponds to the up-down direction, and a thickness direction of the bills corresponds to the front-rear direction.

Figure 5:
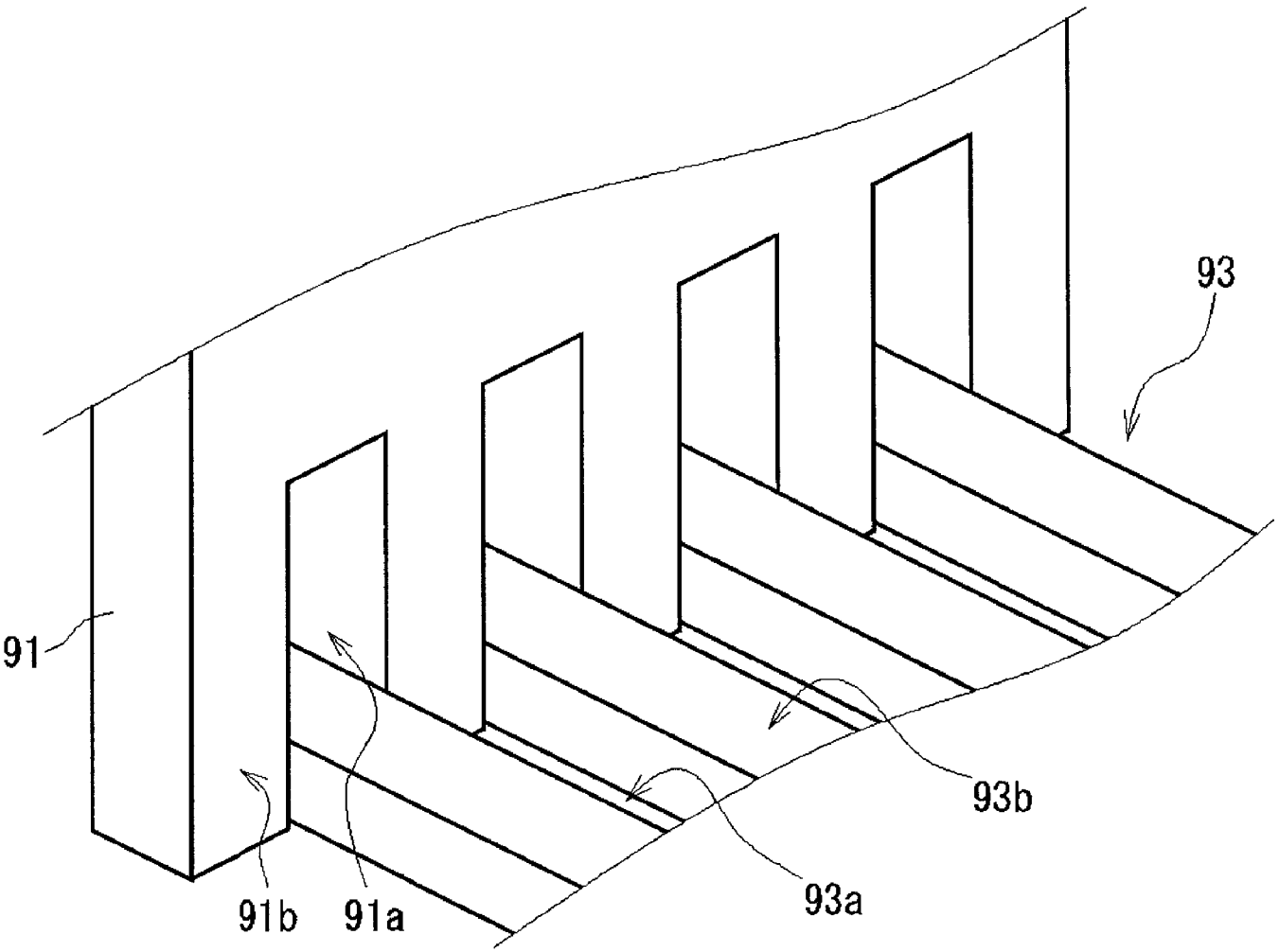
FIG. 5 is a perspective view illustrating a connection part between a bill press and a lift.

In addition, a lift 93 is provided at a middle portion of the lower frame 90 in the front-rear direction. The lift 93 is movable in a rising direction (upward direction) above the lower frame 90 and in a direction opposite to the rising direction (downward direction) in a state where the lift 93 is substantially parallel to atop surface of the lower frame 90. The lift 93 pushes up the bills contained in the container 30 (in other words, in a direction toward the deposit/withdrawal port 5) by moving by a predetermined amount in the rising direction (upward direction) above the top surface of the lower frame 90. Details thereof will be described later. Note that, for example, with reference to FIG. 5 illustrating a schematic perspective view of an upper end section of the lift 93, the upper end section of the lift 93 has a so-called comb-like shape in such a manner that recessed sections 93*a* and protruded sections 93*b* are alternately disposed in the left-right direction and the recessed sections 93*a* and the protruded sections 93*b* are slender in the front-rear direction.

Returning to FIG. 4, the bill press 91 and the pool guide 92 are opposed to each other in the front-rear direction and have a positional relation in such a manner that the bill press 91 is closer to the rear end side of the lower frame 90 and the pool guide 92 is closer to the front end side of the lower frame 90. The container 30 is configured to accumulate bills in an accumulation space Sp formed by the lower frame 90, the bill press 91, the pool guide 92, and the side guides provided on both a left side surface and a right side surface of the container 30.

The bill press 91 is a substantially V-shaped member when viewed from the side surface. The bill press 91 includes a lower plane 91L and an upper plane 91U. The lower plane 91L is a portion that is lower than a bent point of a front surface of the bill press 91 opposed to the pool guide 92 (approximately lower half portion of the front surface) and that is substantially perpendicular to the bottom surface of the container 30. The upper plane 91U is a portion that is higher than the bent point (approximately upper half portion of the front surface) and that obliquely extends from an upper end of the lower plane 91L toward an upper rear direction.

The bill press 91 is configured to be movable in the front-rear direction along the bottom surface of the container 30. The bill press 91 is also configured to be rotatable clockwise or counter-clockwise in the drawings about a rotation axis (not illustrated) extending in the left-right direction. For example, when the bill press 91 having the lower plane 91L that is substantially perpendicular to the bottom surface of the container 30 rotates clockwise in the drawings, the bill press 91 transactions to a state where the upper surface 91U is substantially perpendicular to the bottom of the container 30 (for example, a state illustrated in FIG. 6).

In addition, as illustrated in FIG. 5, a lower end section of the bill press 91 has so-called comb-like shape in such a manner that recessed sections 91*a* and protruded sections 91*b* are alternately disposed in the left-right direction and the lower end section of the bill press 91 is engaged with the upper end section of the lift 93. This allows the lift 93 to move upward until the protruded sections 93*b* of the lift 93 reach an upper end of the recessed sections 91*a* of the bill press 91 even if the bill press 91 is positioned above the lift 93.

In addition, the bill press 91 is provided with a lever 94. The lever 94 is a substantially V-shaped member having a bent portion when viewed from the side surface. A protrusion section 94*a* is provided on an upper end section of a front surface of the lever 94. A lower end section of the front surface of the lever 94 serves as an abutment section 94*b* configured to abut on the lift 93. The lever 94 is provided on a back side (rear side) of the lower plane 94L of the bill press 91, and is supported by the bill press 91 in such a manner that the lever 94 is rotatable clockwise or counter-clockwise in the drawings about a rotation axis 94*c* extending in the left-right direction.

The lever 94 is biased by a torsion spring (not illustrated) provided on the rotation axis 94*c* to maintain a retracted state (for example, state illustrated in FIG. 4) where the whole lever 94 retracts behind the bill press 91. When the lift 93 abuts on the abutment section 94*b* and the abutment section 94*b* is pushed up by the lift 93 with elevation of the lift 93, the lever 94 rotates clockwise in the drawings. This allows the lever 94 to transition from the retracted state to a protruding state (for example, state illustrated in FIG. 7) where only the protrusion section 94*a* protrudes through a hole (not illustrated) made in the lower plane 91L of the bill press 91 near the bent point.

On the other hand, the pool guide 92 is a substantially trapezoidal member when viewed from the side surface. The pool guide 92 has a rear surface that is opposed to the bill press 91 and that is bent like a V shape when viewed from the side surface. The rear surface includes a lower plane 92L and an upper plane 92U. The lower plane 92L is a portion that is lower than a bent point of the rear surface (corresponding to approximately ⅔ of a front surface of the pool guide 92 from the bottom) and that is substantially perpendicular to the bottom surface of the container 30. The upper plane 92U is a portion that is higher than the bent point of the rear surface (corresponding to approximately ⅓ of the front surface from the top) and that obliquely extends from an upper end of the lower plane 92L toward an upper front direction. The pool guide 92 is independent from the bill press 91, and is configured to be movable in the front-rear direction along the bottom surface of the container 30.

Note that, although not illustrated, a lower end section of the pool guide 92 also has so-called comb-like shape in such a manner that recessed sections and protruded sections are alternately disposed in the left-right direction and the lower end section of the pool guide 92 is engaged with the upper end section of the lift 93 in a way similar to the bill press 91. This allows the lift 93 to move upward until the protruded sections 93*b* of the lift 93 reach the upper end of the recessed sections 91*a* of the bill press 91 (or an upper end of the recessed sections of the pool guide 92) even if the bill press 91 and the pool guide 92 are positioned above the lift 93.

The separation/ejection mechanism 81 includes a feed roller 100, a gate roller 101, and a pickup roller 102. The feed roller 100 and the gate roller 101 are provided near a front end of the bottom surface of the container 30, are disposed to face each other across the intake port 90*a* in the front-rear direction, and have a positional relation in such a manner that the gate roller 101 is disposed behind the feed roller 100. The pickup roller 102 is provided at a front end in the container 30 above the feed roller 100. When the pool guide 92 moves to a vicinity of the intake port 90*a*, the pickup roller 102 protrudes through a hole (not illustrated) made in the lower plane 92L of the pool guide 92. In addition, at this time, the pickup roller 102 rotates clockwise in the drawings, comes into contact with a frontmost bill among the bills contained between the bill press 91 and the pool guide 92, and sends the bill to the intake port 90*a*. When the gate roller 101 does not rotate but the feed roller 100 rotates, the feed roller 100 and the gate roller 101 separate the bills sent from the pickup roller 102 and eject the bills one by one from the intake port 90*a* to the conveyance path 32.

The accumulation mechanism 82 includes an accumulation roller 110 and a pressure roller 111. The accumulation roller 110 and the pressure roller 111 are provided near a rear end of the bottom surface of the container 30, are disposed to face each other across the discharge port 90*b* in the front-rear direction, and have a positional relation in such a manner that the pressure roller 111 is disposed behind the accumulation roller 110. When the accumulation roller 110 rotates clockwise in the drawings but the pressure roller 111 rotates counter-clockwise in the drawing, the accumulation mechanism 82 discharges the bills conveyed to the container 30 along the conveyance path 33 from the discharge port 90*b* to a space between the pool guide 92 and the bill press 91 positioned near the discharge port 90*b*, and accumulates the bills. The configuration of the customer interface section 21 has been described above.

5. Positions of Bill Press and Pool Guide

Next, positions of the bill press 91 and the pool guide 92 in the container 30 will be described. Here, an accumulation position and a delivery position will be described as the positions of the bill press 91 and the pool guide 92. The accumulation position is a position for accumulating bills in the accumulation space Sp between the bill press 91 and the pool guide 92. The delivery position is a position for delivering the bills accumulated in the accumulation space Sp between the bill press 91 and the pool guide 92 to the user. Note that, the bill press 91 and the pool guide 92 are opposed to each other in the front-rear direction. Therefore, the accumulation position of the bill press 91 and the accumulation position of the pool guide 92 are set to different positions. In a similar way, the delivery position of the bill press 91 and the delivery position of the pool guide 92 are set to different positions.

Figure 6:
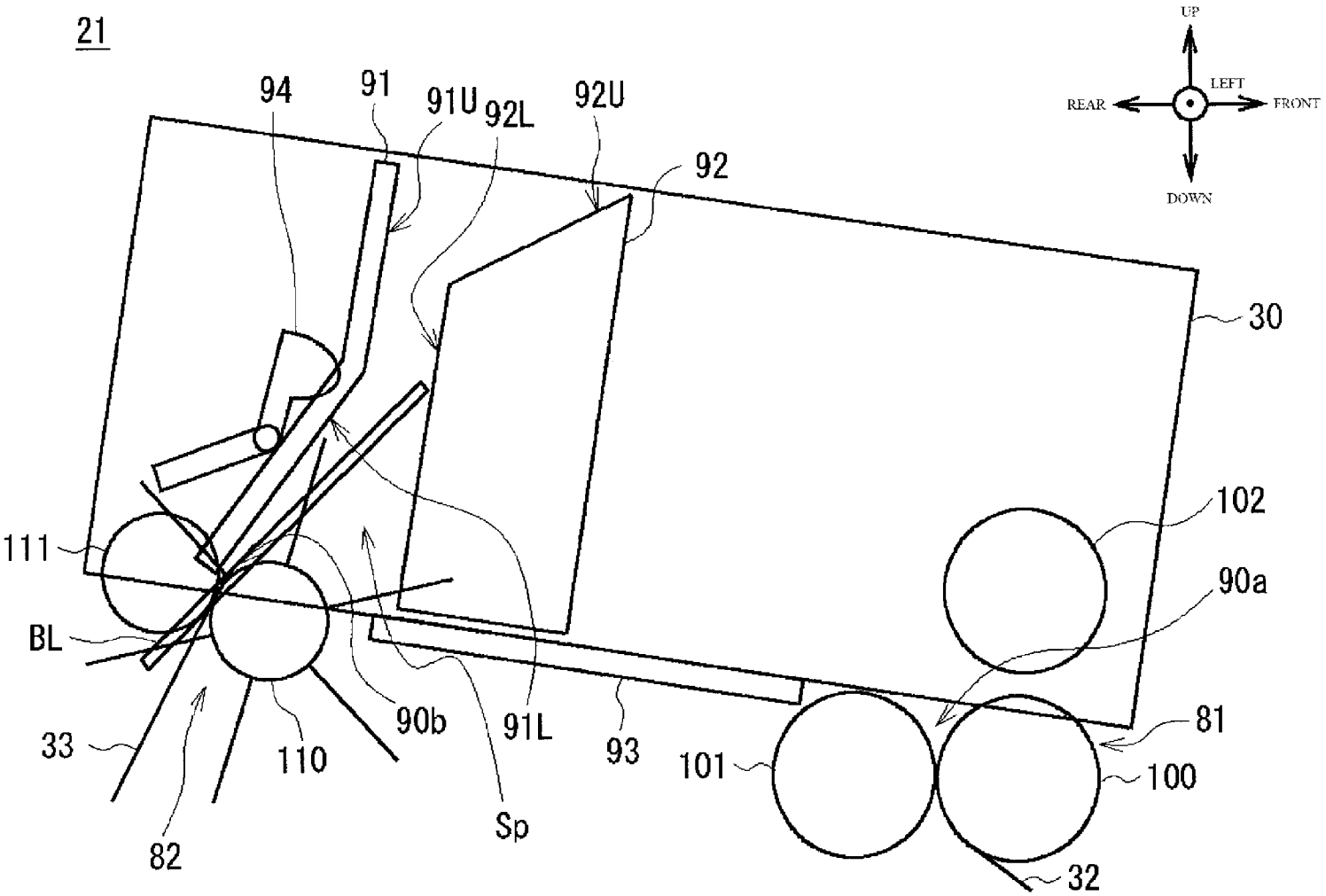
FIG. 6 is a side sectional view illustrating accumulation positions of the bill press and a pool guide.

First, with reference to the enlarged view illustrated in FIG. 6, the accumulation positions will be described. The customer interface section 21 puts the bill press 91 and the pool guide 92 in the accumulation positions for accumulating bills (for example bills to be withdrawn) conveyed along the conveyance path 33 in the accumulation space Sp between the bill press 91 and the pool guide 92.

In other words, the customer interface section 21 puts the bill press 91 and the pool guide 92 in the respective accumulation positions by moving the bill press 91 and the pool guide 92 to vicinities of the discharge port 90*b* and rotating the bill press 91 in such a manner that the upper plane 91U becomes substantially perpendicular to the bottom surface of the container 30. At this time, the bill press 91 enters a state where the upper plane 91U is substantially parallel to the lower plane 92L of the pool guide 92 and the lower plane 91L is tilted rearward with respect to the lower plane 92L of the pool guide 92. In addition, at this time, the bill press 91 also enters a state where the upper plane 91U is positioned anterior to the discharge port 90*b*, and the lower plane 91L is positioned between the discharge port 90*b* and a lower end of the upper plane 91U. In other words, the lower plane 91L of the bill press 91 functions as a guide that guides bills BL discharged from the discharge port 90*b* to a space between the upper plane 91U of the bill press 91 and the lower plane 92L of the pool guide 92. On the other hand, the pool guide 92 enters a state where the upper plane 92U is in proximity to the upper plane 91U of the bill press 91.

By driving the accumulation mechanism 82 in the above-described states, the customer interface section 21 discharges the bills BL from the discharge port 90*b* to the accumulation space Sp between the bill press 91 and the pool guide 92, and accumulates the bills BL between the upper plane 91U of the bill press 91 and the upper plane 92U of the pool guide 92 in such a manner that the bills BL pile in the front-rear direction. In addition, at this time, the customer interface section 21 gradually moves the pool guide 92 in a direction away from the bill press 91 as the number of accumulated bills BL increases.

Next, with reference to the enlarged view illustrated in FIG. 7, the delivery positions will be described. The customer interface section 21 puts the bill press 91 and the pool guide 92 in the delivery positions for delivering bills (for example bills to be withdrawn) accumulated in the accumulation space Sp between the bill press 91 and the pool guide 92 to the user.

In other words, the customer interface section 21 puts the bill press 91 and the pool guide 92 in the respective delivery positions by rotating the bill press 91 in such a manner that the lower plane 91L becomes substantially perpendicular to the bottom surface of the container 30 in the state where the bills BL are accumulated in the accumulation space Sp between the bill press 91 and the pool guide 92 and by moving the bill press 91 and the pool guide 92 to nearly middle positions between the intake port 90*a* and the discharge port 90*b*. At this time, the bill press 91 enters a state where the lower plane 91L is substantially parallel to the lower plane 92L of the pool guide 92 and the upper plane 91U is tilted rearward with respect to the lower plane 92L of the pool guide 92. On the other hand, the pool guide 92 is apart from the bill press 91 in such a manner that a distance between the lower plane 92L of the pool guide 92 and the lower plane 91L of the bill press 91 exceeds the thickness of a set of the bills BL accumulated in the accumulation space Sp.

In addition, at this time, the customer interface section 21 moves the lift 93 upward by a predetermined amount to push the set of the bills BL accumulated in the accumulation space Sp between the bill press 91 and the pool guide 92 upward and rotate the lever 94 in such a manner that the lever 94 transitions from the retracted state to the protruding state. Note that, when the lever 94 enters the protruding state, it is possible to peel bills clinging to the bill press 91 due to static electricity, from the bill press 91, for example. Subsequently, the customer interface section 21 opens the shutter 31 and delivers the bills to the user via the deposit/withdrawal port 5.

6. Operations of Bill Press and Pool Guide

Next, operations performed by the bill press 91 and the pool guide 92 for moving from the above-described accumulation positions to the delivery positions will be described with reference to FIG. 8 to FIG. 12 and the timing chart illustrated in FIG. 13A. Here, the timing chart illustrated in FIG. 13A includes a horizontal axis representing time, and a vertical axis representing positions of the lower end of the front surface of the bill press 91 and positions of the lower end of the rear surface of the pool guide 92. Note that, specifically, the positions put on in the vertical axis means distances from the rear surface of the container 30. Note that, operations of the bill press 91 and the pool guide 92 to be described below are operations controlled by the bill controller 20.

Figure 8:
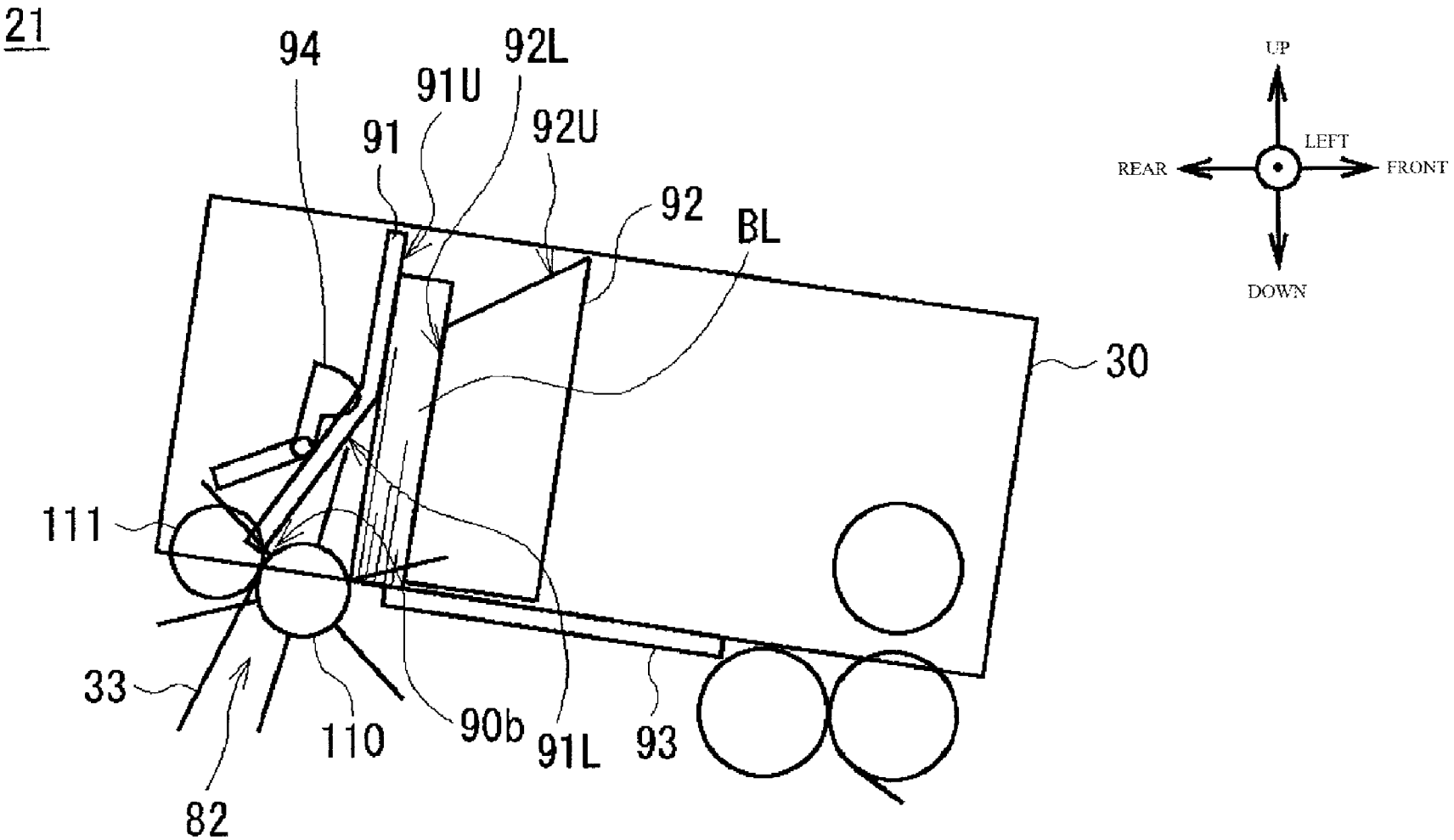
FIG. 8 is a side sectional view illustrating operation of the bill press and the pool guide.
Figure 13A:
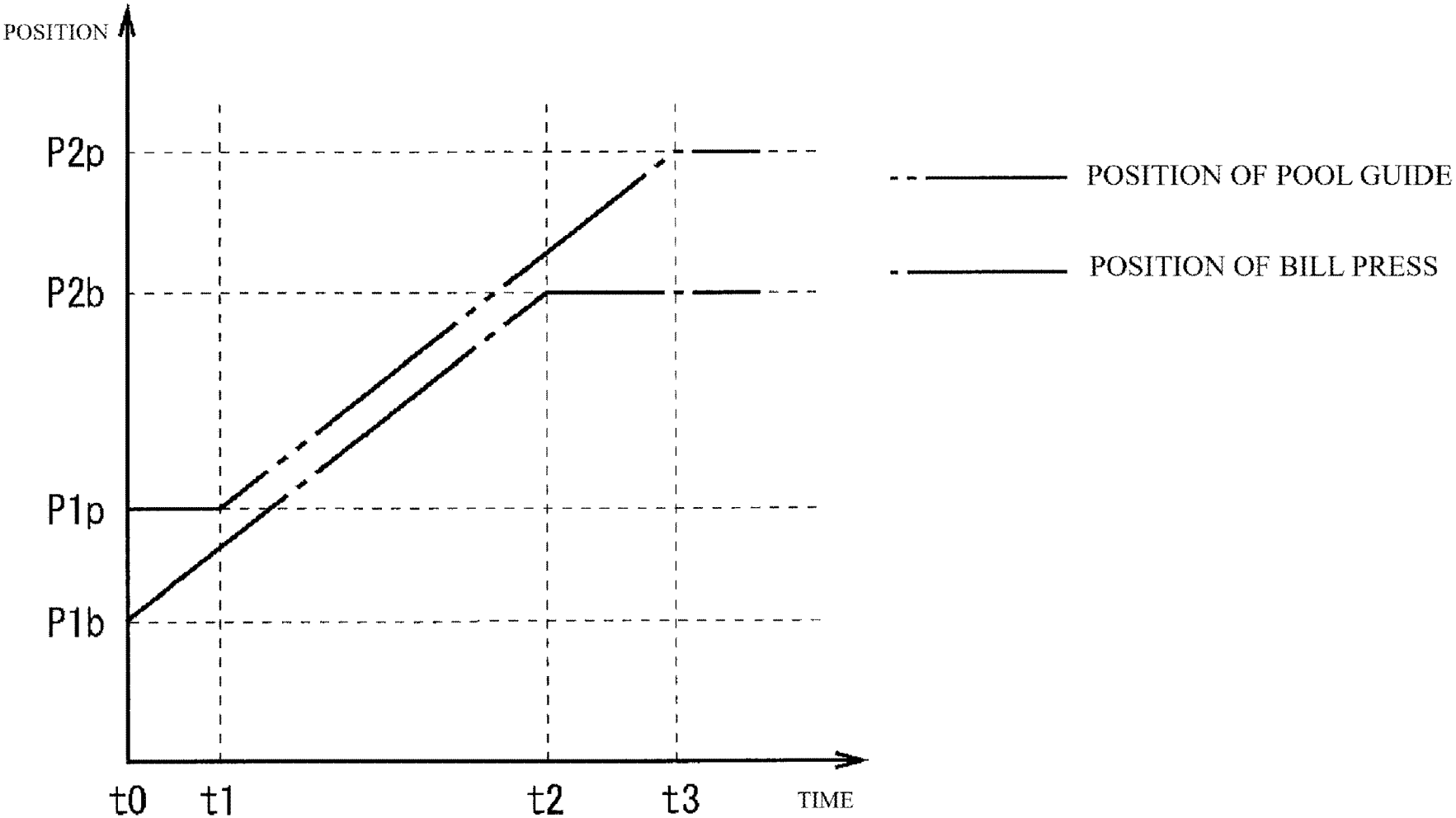
FIG. 13A is a timing chart illustrating the operations of the bill press and the pool guide.

First, FIG. 8 illustrates the bill press 91 and the pool guide 92 at a time point t0 when accumulation of a plurality of bills BL between the accumulation positions is completed (see FIG. 13A). At this time, a set of the bills BL are accumulated between the upper plane 91U of the bill press 91 and the lower plane 92L of the pool guide 92. A position of the lower end of the front surface of the bill press 91 obtained at the time point t0 (in other words, obtained at the accumulation position) is referred to as a position P1b, and a position of the lower end of the rear surface of the pool guide 92 obtained at the time point t0 (in other words, obtained at the accumulation position) is referred to as a position P2b (see FIG. 13A).

Figure 9:
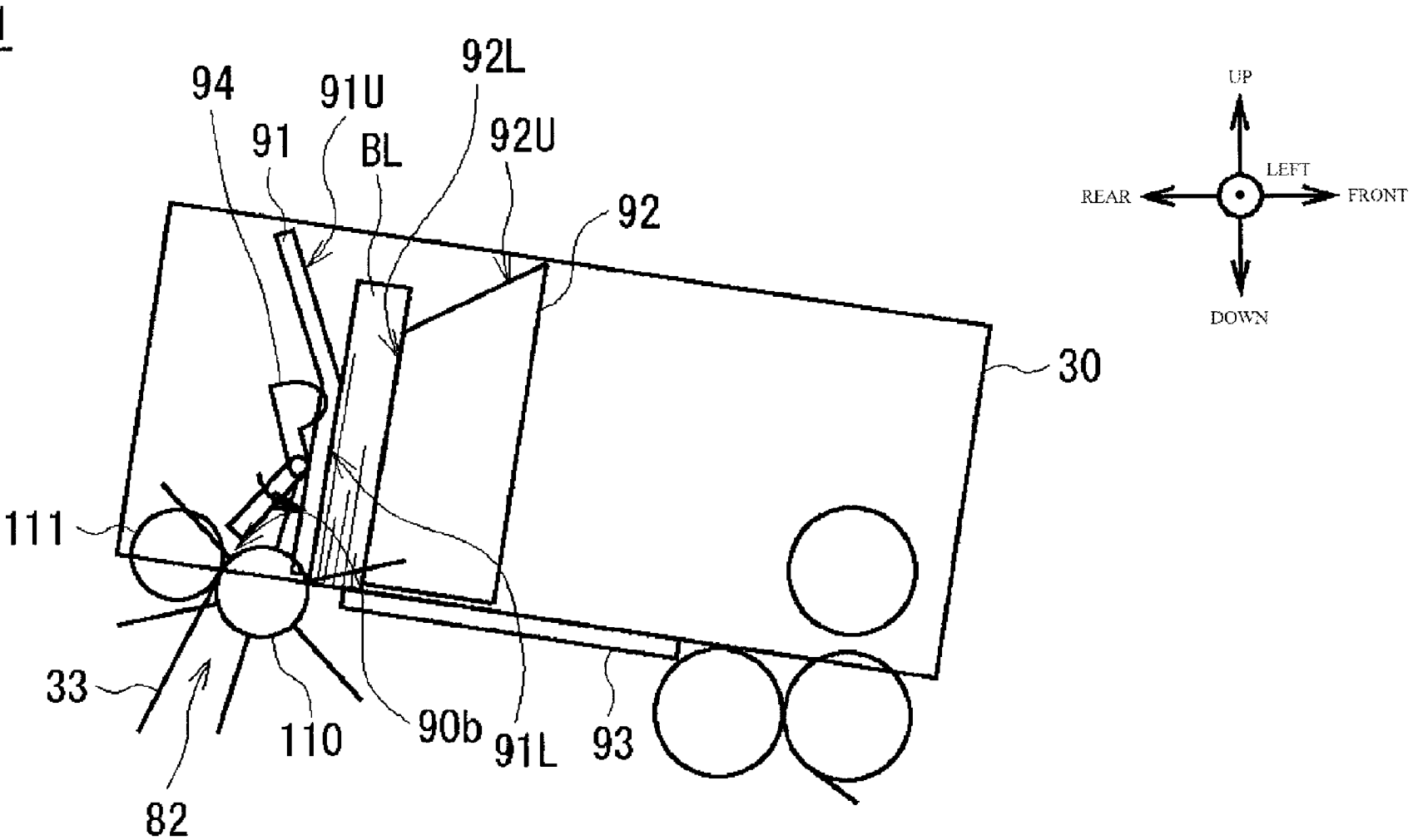
FIG. 9 is a side sectional view illustrating operation of the bill press and the pool guide subsequent to the operation illustrated in FIG. 8.

When the accumulation of the bills BL are completed, the customer interface section 21 rotates the bill press 91 counter-clockwise in the drawing in a time period from the time point t0 to a time point t1 in such a manner that the lower plane 91L becomes substantially perpendicular to the bottom surface of the container 30 (in other words, the lower plane 91L becomes substantially parallel to the lower plane 92L of the pool guide 92) as illustrated in FIG. 9. At this time, the set of the bills BL are sandwiched between the lower plane 91L and the lower plane 92L of the pool guide 92 when the lower end of the front surface of the bill press 91 approaches the lower end of the rear surface of the pool guide 92.

Figure 10:
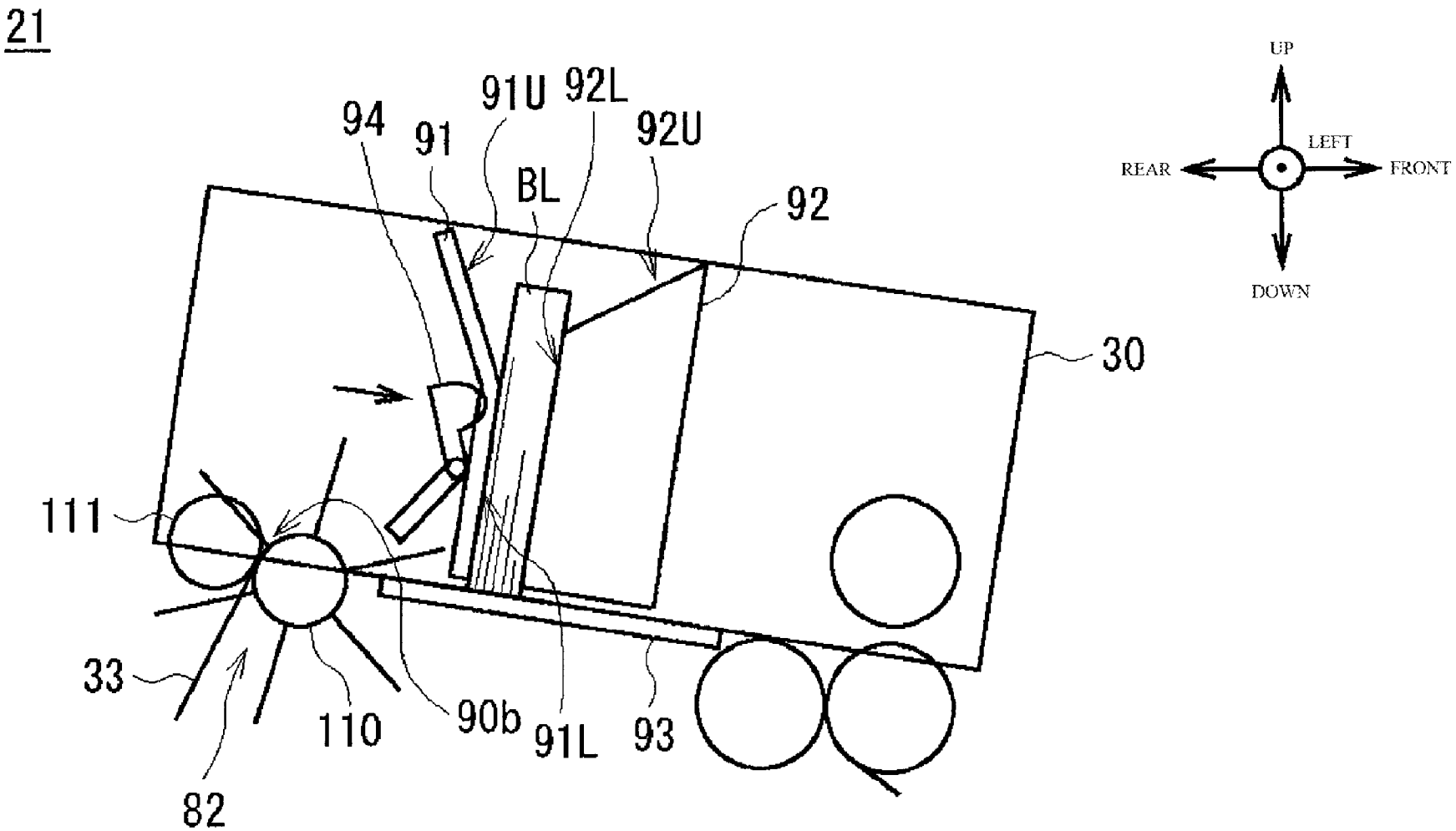
FIG. 10 is a side sectional view illustrating operation of the bill press and the pool guide subsequent to the operation illustrated in FIG. 9.

After the time point t1, the customer interface section 21 moves the bill press 91 and the pool guide 92 in a (forward) direction toward the delivery positions at substantially same speeds while maintaining the gap between the bill press 91 and the pool guide 92 (in other words, while maintaining the size of the gap that is substantially the same as the thickness of the set of the accumulated bills BL) as illustrated in FIG. 10. Next, the customer interface section 21 stops moving the bill press 91 at a time point t2 when the bill press 91 reaches the delivery position. A position of the lower end of the front surface of the bill press 91 obtained at the time point t2 is referred to as a position P2b.

As described above, the customer interface section 21 moves the bill press 91 and the pool guide 92 in the (forward) direction toward the respective delivery positions set with regard to the bill press 91 and the pool guide 92 while maintaining the gap between the bill press 91 and the pool guide 92 in the time period from the time point t1 to the time point t2. This makes it possible to prevent the set of bills accumulated between the bill press 91 and the pool guide 92 from becoming disarrayed while moving.

Figure 11:
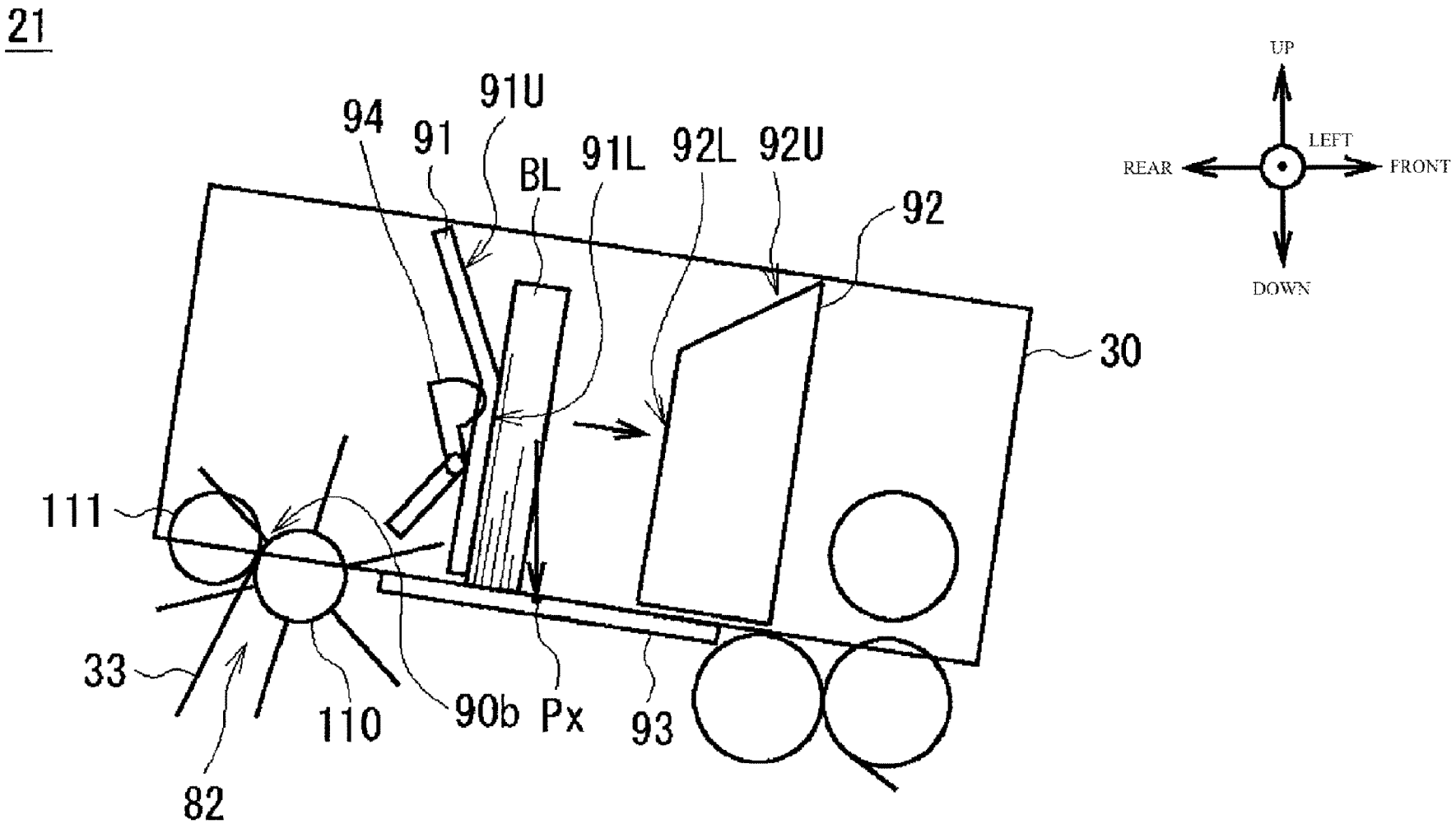
FIG. 11 is a side sectional view illustrating operation of the bill press and the pool guide subsequent to the operation illustrated in FIG. 10.

In addition, even after the time point t2 when the bill press 91 stops moving, the customer interface section 21 keeps moving the pool guide 92 forward as illustrated in FIG. 11, and then stops moving the pool guide 92 at a time point t3 when the pool guide 92 reaches its delivery position. A position of the lower end of the rear surface of the pool guide 92 obtained at the time point t3 is referred to as a position P2p.

As described above, after the bill press 91 is stopped at its delivery position, the customer interface section 21 further moves the pool guide 92 by a predetermined amount to its delivery position in the time period from the time point t2 to the time point t3. This makes possible to widen the gap between the bill press 91 and the pool guide 92 more than the gap obtained by moving both the bill press 91 and the pool guide 92 while maintaining the size of the gap that is substantially the same as the thickness of the set of the accumulated bills BL. Therefore, when the bill press 91 and the pool guide 92 are moved to their delivery positions, it is possible for the customer interface section 21 to widen the gap between the bill press 91 and the pool guide 92 more than the thickness of the set of the accumulated bills BL, and this makes it easier to take out the set of bills BL from the gap between the bill press 91 and the pool guide 92.

In addition, at this time, the whole container 30 is tilted forward. Therefore, with regard to the bills BL accumulated between the bill press 91 and the pool guide 92, an intersection Px of the bottom surface of the container 30 with a hypothetical line extending from a center of gravity of the bills BL toward a direction of gravitational force is positioned anterior to a contact point between a lower end of the bills BL and the bottom surface of the container 30 (in other words, the intersection Px is closer to the pool guide 92).

Figure 12:
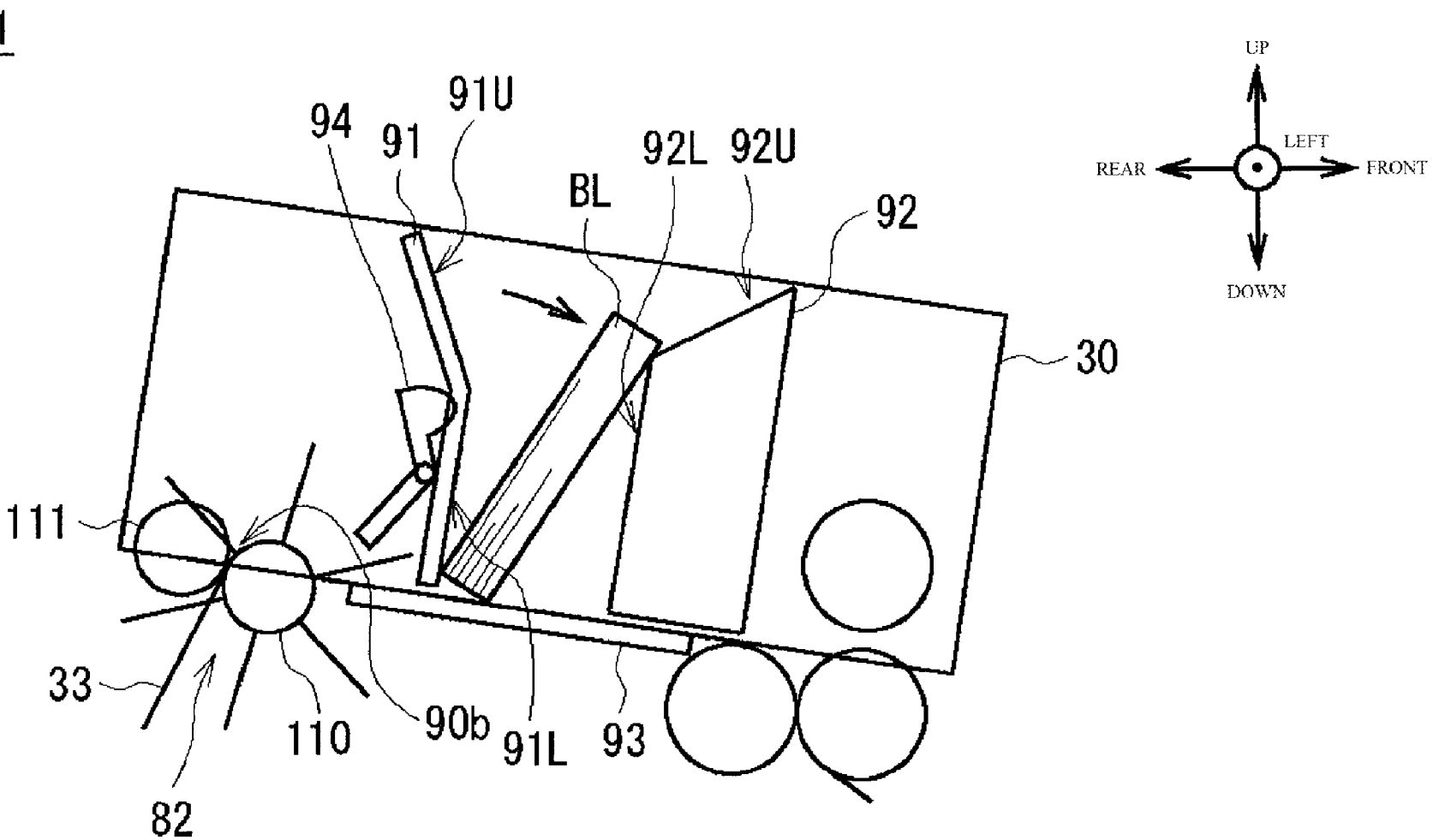
FIG. 12 is a side sectional view illustrating operation of the bill press and the pool guide subsequent to the operation illustrated in FIG. 11.

Therefore, when the pool guide 92 moves forward, the bills BL accumulated between the bill press 91 and the pool guide 92 tilt and an upper end section of the bills BL reaches the pool guide 92 while a lower end section of the bills BL remains on the bill press 91 as illustrated in FIG. 12, and the bills BL lean on the front surface of the pool guide 92. Accordingly, it is possible for the customer interface section 21 to prevent the set of bills BL accumulated between the bill press 91 and the pool guide 92 from becoming disarrayed, and this makes it easier to take out the set of bills BL even if the pool guide 92 moves away from the bill press 91 and the gap between the bill press 91 and the pool guide 92 increases. Note that, for explanatory convenience, FIG. 11 and FIG. 12 illustrates the bills BL as if the bills BL lean on the pool guide 92 after the pool guide 92 reaches its delivery position. However, in practice, the bills BL gradually tilts toward the pool guide 92 while the pool guide 92 is moving away from the bill press 91. In addition, at this time, the bills BL may topple over the lower frame 90 if the pool guide 92 is too far from the bill press 91 located on its delivery position. This makes it difficult to take out the bills BL. Therefore, a distance of the movement of the pool guide 92 obtained in the time period from the time point t2 to the time point t3 is shorter than the short side of the bills BL.

As described above, the customer interface section 21 allows the bills BL accumulated between the bill press 91 and the pool guide 92 to lean on the pool guide 92. This makes it possible to prevent the bills accumulated between the bill press 91 and the pool guide 92 from becoming disarrayed even if the gap between the bill press 91 and the pool guide 92 increases.

As described above, the customer interface section 21 moves the bill press 91 and the pool guide 92 from the accumulation positions to the delivery positions. Subsequently, as illustrated in FIG. 7, the customer interface section 21 elevates the lift 93 disposed below the bill press 91 and the pool guide 92 located on the delivery positions. This allows the set of bills BL leaning on the front surface of the pool guide 92 to get closer to the deposit/withdrawal port 5, and this makes it easier for the user to take out the set of bills BL. In addition, at this time, the lever 94 rotates with elevation of the lift 93 in such a manner that the lever 94 transitions from the retracted state to the protruding state. This allows the customer interface section 21 to peel bills BL clinging to the bill press 91 due to static electricity, from the bill press 91, for example, and this makes it easier to take out the bills BL.

7. Conclusion and Effect

As described above, while the bill controller 20 is moving the bill press 91 and the pool guide 92 from the accumulation positions to the delivery positions, the bill deposit/withdrawal device 10 secures the time period (first time period) from the time point t1 to the time point t2 for moving both the bill press 91 and the pool guide 92 and the time period (second time period) from the time point t2 to the time point t3 for moving only the pool guide 92.

Therefore, in the first time period, it is possible for the bill deposit/withdrawal device 10 to move the bill press 91 and the pool guide 92 in a direction from the accumulation positions toward the delivery positions while maintaining a gap between the bill press 91 and the pool guide 92. This makes it possible to prevent bills accumulated between the bill press 91 and the pool guide 92 from becoming disarrayed while moving. In addition, in the second time period, the gap between the bill press 91 and the pool guide 92 are widened. This makes it easier to take out the bills.

In addition, the customer interface section 21 of the bill deposit/withdrawal device 10 is provided with the lift 93 that pushes up the bills accumulated between the bill press 91 and the pool guide 92 located on the delivery positions, in a direction toward the deposit/withdrawal port 5. This makes it possible to take out the bills from the bill deposit/withdrawal device 10 more easily.

In addition, the customer interface section 21 of the bill deposit/withdrawal device 10 is provided with the lever 94 that protrudes from the front surface of the bill press 91 (a surface of the bill press 91 closer to the pool guide 92) in tandem with operation of the lift 93, to peel the bills clinging to the bill press 91 from the bill press 91. This makes it possible to avoid the situation where the bills cling to the bill press 91, and to take out the bills from the bill deposit/withdrawal device 10 more easily.

Next, instead of the case where the bill press 91 is stopped at its delivery position and then the pool guide 92 further moves to its delivery position as described above with regard to the bill deposit/withdrawal device 10 according to the above-described embodiment of the present invention, a case where the bill press 91 and the pool guide 92 moves to their delivery positions while gradually increasing the gap between the bill press 91 and the pool guide 92 will be briefly described.

Figure 13B:
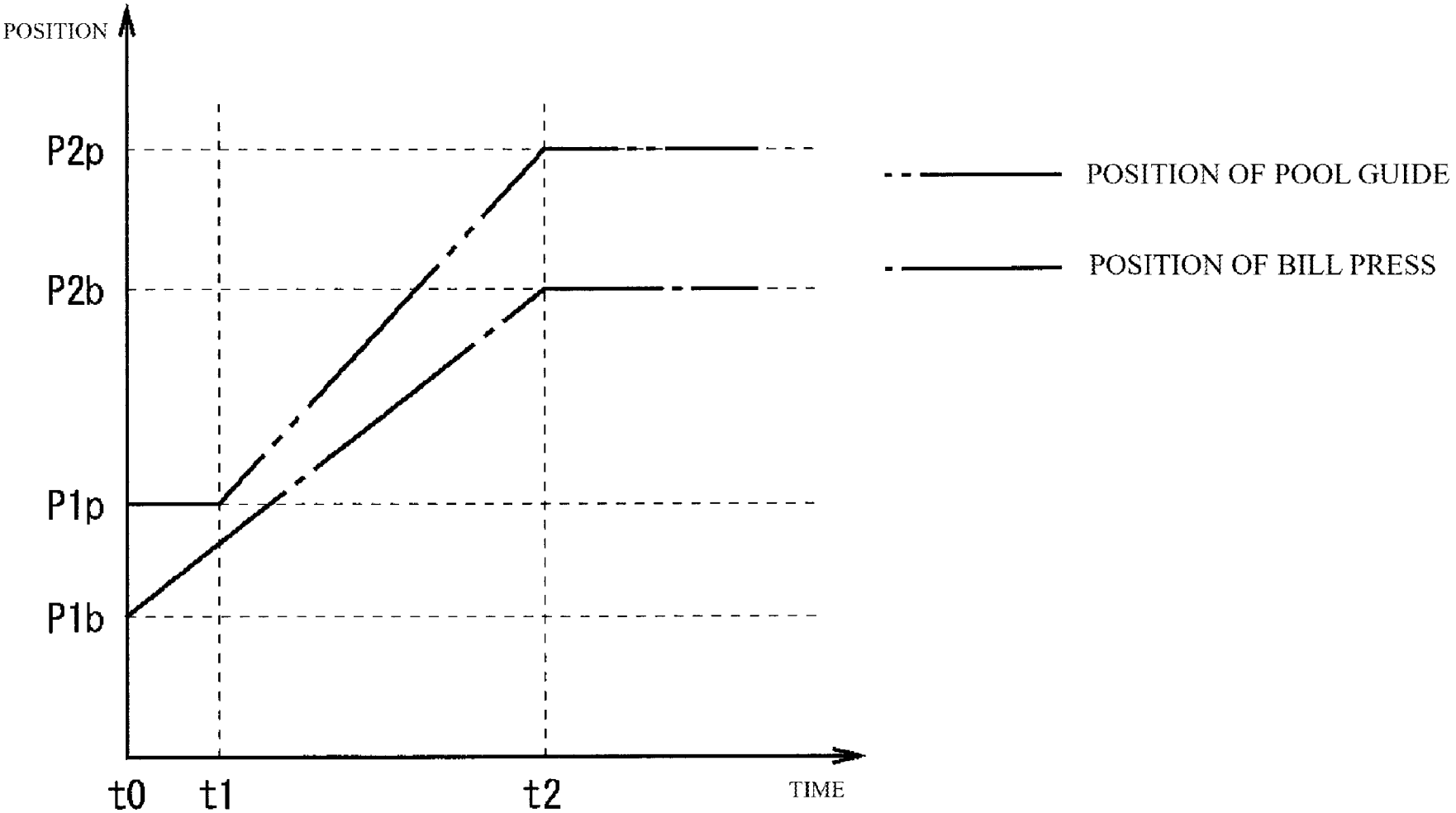
FIG. 13B is a timing chart illustrating operations of a bill press and a pool guide.

Operations of the bill press 91 and the pool guide 92 performed in such a case will be described with reference to a timing chart illustrated in FIG. 13B. In this case, the bill deposit/withdrawal device 10 rotates the bill press 91 in a time period from a time point t0 when accumulation of a plurality of bills BL between the accumulation positions is completed to a time point t1. The bill press 91 and the pool guide 92 operate in the same way as the operation illustrated in FIG. 13A.

Figure 14:
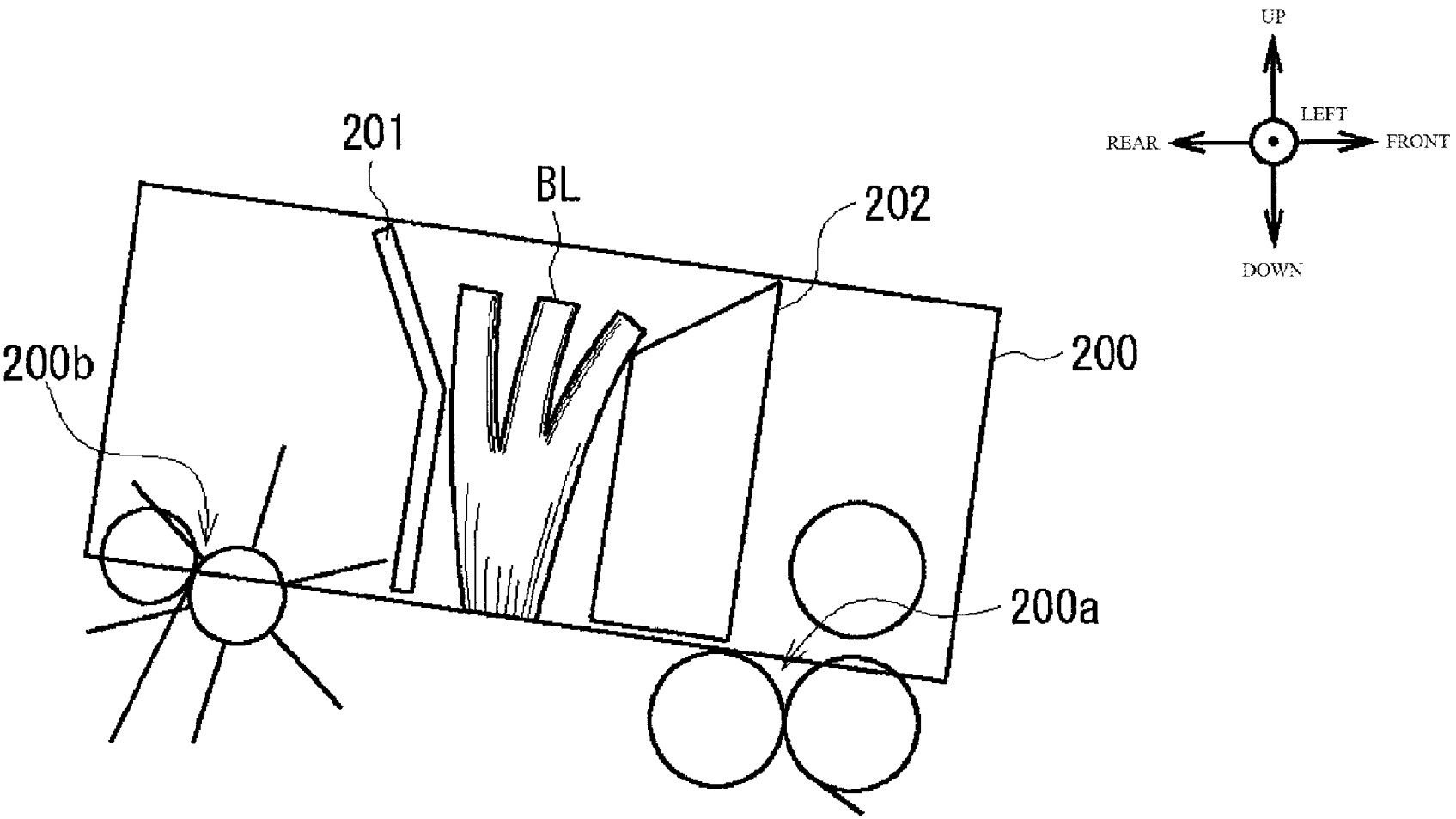
FIG. 14 is a side sectional view illustrating a configuration of a conventional customer interface section.

Next, the bill press 91 and the pool guide 92 move while gradually increasing the gap between the bill press 91 and the pool guide 92 in a time period from the time point t1 to a time point t2. At the time point t2, the bill press 91 and the pool guide 92 reach the respective delivery positions and stop moving. In this case, the gap between the bill press 91 and the pool guide 92 gradually increases while the bill press 91 and the pool guide 92 are moving to the delivery positions. Therefore, sometimes bills accumulated between the bill press 91 and the pool guide 92 may become disarrayed (See FIG. 14).

In the case where the bills become disarrayed in a space between the bill press 91 and the pool guide 92 as described above, it is necessary for the lever 94 to have a function of peeing the bills from the bill press 91 and a function of pushing the bills leaning on the bill press 91 back to the pool guide 92 in such a manner that the bills lean on the pool guide 92.

Figure 7:
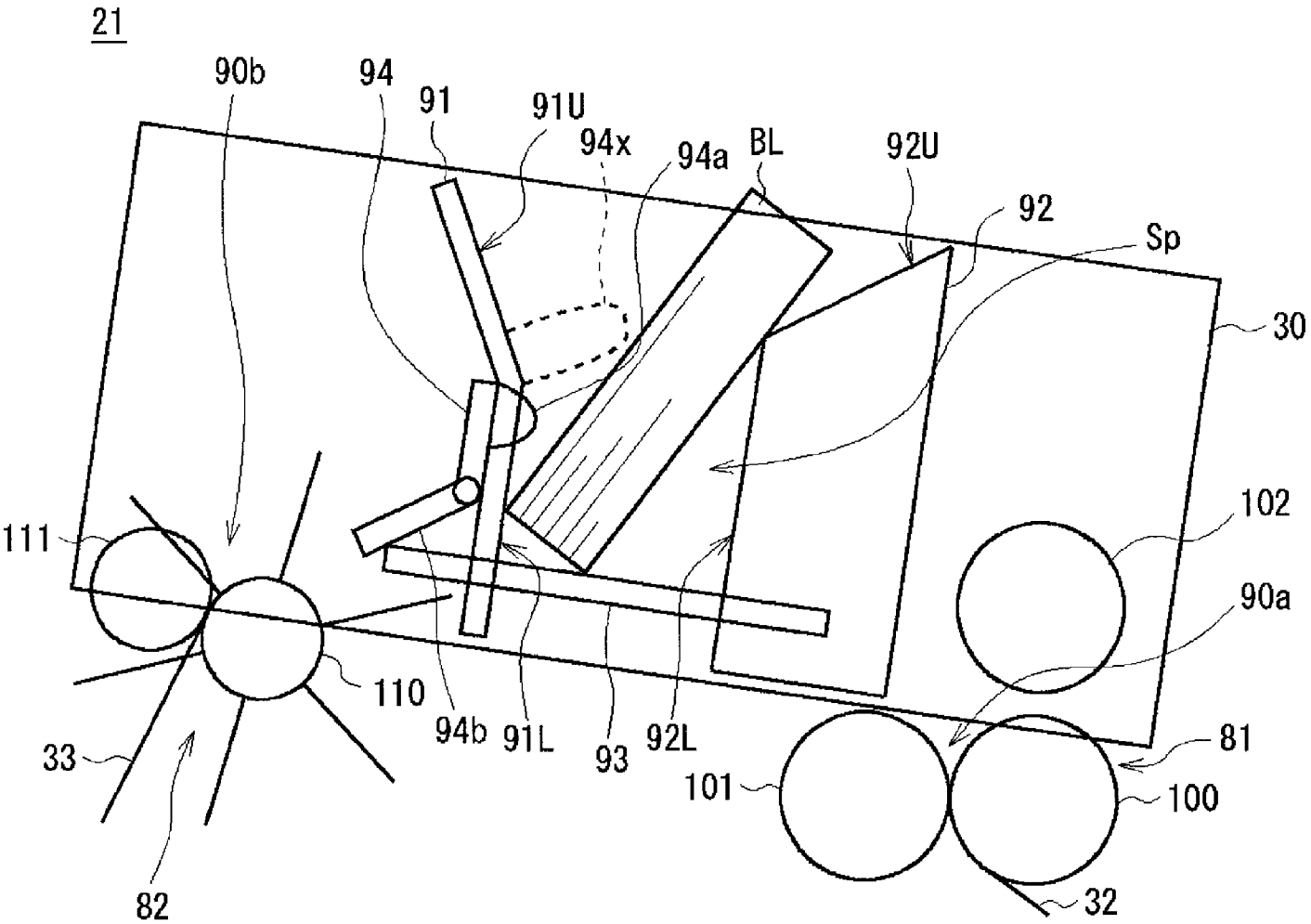
FIG. 7 is a side sectional view illustrating delivery positions of the bill press and the pool guide.

In this case, for example, the lever 94 has to be provided with a protrusion section 94*x* whose amount of protrusion form the bill press 91 is larger than the protrusion section 94*a* as indicated by a dotted line in FIG. 7, and the protrusion section 94X may become a hindrance when taking out the bills.

On the other hand, when using the bill deposit/withdrawal device 10 according to the embodiment of the present invention, the bill press 91 is stopped at its delivery position and then the pool guide 92 moves away from the bill press 91. This allows the bills to naturally lean on the front surface of the pool guide 92. In such a way, it is only necessary for the bill deposit/withdrawal device 10 according to the embodiment of the present invention to provide the lever 94 with the protrusion section 94*a* having a minimum amount of protrusion required to peel the bills from the bill press 91. The protrusion section 94*a* does not become a hindrance when taking out the bills, and this makes it easier to take out the bills.

8. Other Embodiments

8-1. Other Embodiment 1

In addition, according to the above-described embodiment, in the first time period, the bill press 91 and the pool guide 92 move in a (forward) direction toward the respective delivery positions, and when the bill press 91 reaches its delivery position, the bill press 91 stops moving. Subsequently, in the second time period, only the pool guide 92 moves in a (forward) direction away from the bill press 91 and reaches its delivery position. The present invention is not limited thereto. For example, in the first time period, the bill press 91 and the pool guide 92 may move in the (forward) direction toward the respective delivery positions, and when the pool guide 92 reaches its delivery position, the pool guide 92 may stop moving. Subsequently, in the second time period, only the bill press 91 may move in the (rear) direction away from the pool guide 92 and may reach its delivery position.

In addition, the present invention is not limited thereto. For example, the bill press 91 and the pool guide 92 may move in a (forward) direction toward the respective delivery positions, and when the bill press 91 reaches its delivery position, the bill press 91 may stop moving. Subsequently, the pool guide 92 may move forward and reach its delivery position while the bill press 91 is slightly returning backward.

8-2. Other Embodiment 2

In addition, according to the above-described embodiment, in the first time period, the bill press 91 stops moving when the bill press 91 reaches its delivery position. Subsequently, in the second time period, only the pool guide 92 moves by a predetermined amount in a (forward) direction away from the bill press 91 and reaches its delivery position. Here, the amount of movement of the pool guide 92 obtained after the bill press 91 stops moving may be a constant amount that has been set in advance, or may vary depending on the number of bills accumulated between the bill press 91 and the pool guide 91. In the case where the amount of movement of the pool guide 92 obtained after the bill press 91 stops moving varies depending on the number of bills accumulated between the bill press 91 and the pool guide 91, it is sufficient to increase the amount of movement as the number of accumulated bills increases, for example.

8-3. Other Embodiment 3

In addition, according to the above-described embodiment, the lever 94 of the bill press 91 rotates and transitions from the retracted state to the protruding state when the lift 93 pushes up the abutment section 94*b* of the lever 94. However, the present invention is not limited thereto. For example, the lever 94 and the lift 93 may be coupled to each other via another link mechanism, and the lever 94 may rotate with elevation of the lift 93. In addition, the present invention is not limited thereto. For example, driving force of a motor or the like may be used for rotating the lever 94 independently from the lift 93.

8-4. Other Embodiment 4

In addition, according to the above-described embodiments, the present invention is applied to the bill deposit/withdrawal device 10 serving as the medium processing device. However, the present invention is not limited thereto. The present invention may be applied to a medium processing device that process media other than the bills, such as gift certificate, gift voucher, tickets, or forms. In addition, according to the above-described embodiments, the present invention is applied to the automatic teller machine 1 serving as the automated teller machine. However, the present invention is not limited thereto. The present invention may be applied to an automated teller machine that handles media other than the bills, such as gift certificate, gift voucher, tickets, or forms. In addition, according to the above-described embodiments, the present invention is applied to the bill deposit/withdrawal device 10 and the automatic teller machine 1 that handle both deposit transactions and withdrawal transactions. However, the present invention is not limited thereto. The present invention may be applied to a medium processing device and an automatic teller machine that handle withdrawal transactions only.

8-5. Other Embodiment 5

In addition, according to the above-described embodiments, the bill deposit/withdrawal device 10 includes the bill controller 20, which is a specific example of a control section for controlling operations of the bill press 91, the pool guide 92, the lift 93, and the lever 94. However, the present invention is not limited thereto. For example, such a control section may be installed in the customer interface section 21.

8-6. Other Embodiment 6

Moreover, the present invention is not limited to the above-described embodiments and the other embodiments described above. Namely, the present invention encompasses application to embodiments combining some or all of the embodiments described above and the other embodiments described above, and embodiments deriving from elements thereof.

INDUSTRIAL APPLICABILITY

The present invention is applicable to various devices that include a bill press and a pool guide and that accumulate media between the bill press and the pool guide.

REFERENCE SIGNS LIST

1 automatic teller machine
5 deposit/withdrawal port
10 bill deposit/withdrawal device
20 bill controller
21 customer interface section
30, 200 container
31 shutter
90 lower frame
90*a* intake port
90*b* discharge port
91, 201 bill press
92, 202 pool guide
93 lift
94 lever
94*a* protrusion section
94*b* abutment section
94*c* rotation axis
BL bill

The invention claimed is:

1. A medium processing device comprising:

a container configured to contain a medium to be delivered to a user;

a bill press and a pool guide configured to be opposed to each other in the container and movable in the container; and a control section configured to control movements of the bill press and the pool guide, wherein a first time period and a second time period subsequent to the first time period are provided while the control section causes each of the bill press and the pool guide to move from an accumulation position to a delivery position, the first time period being a time period where both the bill press and the pool guide move, the second time period being a time period in which after the bill press reaches the delivery position, the pool guide moves in a direction away from the bill press and reach the delivery position, the accumulation position being a position for accumulating the medium conveyed to the container between the bill press and the pool guide, the delivery position being a position for delivering the medium accumulated between the bill press and the pool guide to the user.

2. The medium processing device according to claim 1, wherein the container has a bottom surface that is tilted in such a manner that one end side is positioned higher than another end side, the bill press and the pool guide that are opposed to each other have a positional relation in such a manner that the bill press is closer to the one end side of the bottom surface and the pool guide is closer to the other end side of the bottom surface, and the respective delivery positions of the bill press and the pool guide are closer to the other end side of the bottom surface of the container than the respective accumulation positions of the bill press and the pool guide.

3. The medium processing device according to claim 1, wherein, in the second time period, the control section causes only the pool guide to move in the direction away from the bill press by a certain amount set in advance and reach the delivery position.

4. The medium processing device according to claim 1, wherein, in the second time period, the control section causes only the pool guide to move in the direction away from the bill press by an amount of movement corresponding to the number of media accumulated between the pool guide and the bill press, and causes only the pool guide to reach the delivery position.

5. The medium processing device according to claim 1, comprising a lift configured to be movable in an elevating direction above the bottom surface of the container and in an opposite direction to the elevating direction, wherein, when both the bill press and the pool guide have reached the respective delivery positions, the control section causes the lift to move in the elevating direction above the bottom surface of the container and push up the medium accumulated between the bill press and the pool guide.

6. The medium processing device according to claim 5, comprising a lever provided with a protrusion section configured to protrude toward the pool guide from a surface of the bill press, the surface being opposed to the pool guide, and wherein the lever is capable of transitioning to a protruding state and a retracted state, and when both the bill press and the pool guide have reached the respective delivery positions, the lever transitions from the retracted state to the protruding state, the protruding state being a state where the protrusion section protrudes from the surface of the bill press, the retracted state being a state where the protrusion section retracts behind the bill press.

7. The medium processing device according to claim 6, wherein an amount of protrusion of the protrusion section from the surface of the bill press is an amount necessary to separate the medium touching the surface of the bill press from the surface of the bill press.

8. The medium processing device according to claim 6, wherein the lever includes an abutment section configured to abut on the lift when the lift moves in the elevating direction, and the lever transitions from the retracted state to the protruding state when the abutment section that abuts on the lift is pushed up.

9. An automated teller machine comprising the medium processing device according to claim 1.

* * * * *